United States Patent [19]

Stuart

[11] 4,026,096

[45] May 31, 1977

[54] DOFF AND START-UP CONTROL APPARATUS FOR TEXTILE YARN PROCESSING MACHINE

[75] Inventor: William I. Stuart, Chester, S.C.

[73] Assignee: Springs Mills, Inc., Fort Mill, S.C.

[22] Filed: Aug. 20, 1976

[21] Appl. No.: 716,159

Related U.S. Application Data

[63] Continuation-in-part of Ser. No. 569,397, April 18, 1975, abandoned, which is a continuation-in-part of Ser. No. 436,183, Jan. 24, 1974, abandoned, which is a continuation-in-part of Ser. No. 173,602, Aug. 20, 1971, abandoned.

[52] U.S. Cl. ..... 57/54; 57/79; 57/99; 57/110; 57/111; 242/26.4

[51] Int. Cl.[2] ..... D01H 9/14; D01H 13/06; D01H 1/36

[58] Field of Search ..... 57/54, 79, 98–99, 57/110–111; 242/26.1, 26.3, 26.4

[56] References Cited

UNITED STATES PATENTS

| | | | |
|---|---|---|---|
| 2,373,263 | 4/1945 | Rowe | 57/54 |
| 2,503,099 | 4/1950 | Culbreath | 57/79 |
| 3,095,684 | 7/1963 | Rogers | 57/54 |
| 3,138,339 | 6/1964 | Jones, Sr. | 242/26.4 |
| 3,175,350 | 3/1965 | Powell, Sr. et al. | 57/54 |
| 3,336,739 | 8/1967 | Sanders et al. | 57/54 |

*Primary Examiner*—Richard C. Queisser
*Assistant Examiner*—Charles Gorenstein
*Attorney, Agent, or Firm*—Bell, Seltzer, Park & Gibson

[57] ABSTRACT

In a textile yarn processing machine, such as spinning and twisting machines, the combination therewith of control apparatus for automating movements of various elements of the yarn processing machine for preparing the same for doffing of full packages and for starting-up of new packages of processed yarn including combinations and subcombinations of the following. Independent hydraulic fluid operated devices are connected to the builder motion mechanisms of the machine including a piston and cylinder device positively connected between the crank arm of the builder motion mechanisms and the machine frame for relative reciprocating movement with respect to each other during reciprocating movements of the crank arm and the ring rail of the machine. The fluid operated devices cooperate with the builder motion mechanisms for lowering the ring rail to a doffing position, assisting the ring rail to raise under the influence of the builder motion mechanisms to a yarn processing position by at least controlling the speed of raising of the ring rail, and lowering and jogging the ring rail up and down adjacent the bottom of the bobbins on the spindles for removing slack and for bunch or wrap building of the yarn during start-up. An electrical circuit control is connected with the fluid operated devices for being actuated to control the fluid operated devices through the operating sequences. A solenoid operated latch member, hydraulically operated yarn guides and a builder motion rewind mechanism may be included and controlled by the positioning of the ring rail in desired positions and through the electrical circuit control.

26 Claims, 20 Drawing Figures

FULL PACKAGE POSITION

DOFF POSITION

BUNCH OR WRAP BUILDING POSITION

START OF NORMAL BUILDING OPERATION

FULL PACKAGE POSITION

DOFF POSITION

BUNCH BUILDING POSITION

DOFF AND START-UP CONTROL APPARATUS FOR TEXTILE YARN PROCESSING MACHINE

This application is filed under the provisions of 35 USC 120 and 37 CFR 1.60 and is a continuation in part of prior copending U.S. application Ser. No. 569,397, filed Apr. 18, 1975, which in turn was filed under said provisions and was a continuation in part of prior copending application Ser. No. 436,183, filed Jan. 24, 1974 and now abandoned, and which in turn was filed under said provisions and was a continuation in part of prior copending U.S. application Ser. No. 173,602, filed Aug. 20, 1971 and now abandoned.

This invention relates to combinations and subcombinations of control apparatus for automating various movements of various elements, including particularly the ring rail, of textile yarn processing machines, such as spinning and twisting machines or the like, for preparing the yarn processing machine for doffing of full packages of processed yarn and for starting-up of new packages of processed yarn.

BACKGROUND OF THE INVENTION

Conventional textile yarn processing machines, such as spinning and twisting machines or the like, include a plurality of rotating spindles disposed in generally straight lines and positioned on each side of the machine and carried by a stationary frame of the machine. A ring rail mechanism is vertically reciprocated up and down about each line of spindles on each side of the machine for guiding yarn being processed by the machine onto bobbins carried by the spindles in predetermined patterns for building packages of processed yarn. Builder motion mechanisms are provided which are connected with the ring rail for reciprocating the ring rail in predetermined desired patterns during normal yarn processing.

Yarn guide means are associated with each of the spindles and in later designs of yarn processing machines are mounted for vertical reciprocating movement up and down with the ring rail for guiding yarn to the ring rail and to the spindles during yarn processing.

After the packages of processed yarn have been built on the spindles of the machine, it is necessary to lower the ring rail mechanism to a position lower than a normal operating position below the bobbins on the spindles. It is usually also necessary to move the yarn guide devices away from the axes of the spindles for doffing the full packages of processed yarn from the spindles. When the ring rail is lowered to the doffing position, it is necessary to rewind the builder motion mechanisms of the yarn processing machine for subsequent building of new packages of processed yarn.

After the packages of processed yarn have been doffed, the ring rail mechanism of the machine is raised to an operating position by the builder motion mechanism and the yarn guides are returned to their processing position axially above the spindles for starting-up of the processing of new packages of yarn on the spindles. Since slack, kinks and yarn tails are usually present in the yarn during the start-up operation, the ring rail must be jogged up and down adjacent the lower end of the bobbins on the spindles for removing the slack, kinks and tails in the yarn so that a satisfactory start-up operation is accomplished. Also, a bunch of yarn or a tie down end of yarn is desired to be formed on the lower end of the package for well-known purposes in continued use of the package of processed yarn and for this purpose the ring rail is jogged up and down to build a bunch of yarn around the bottom of the package or the ring rail is held in a lower position or jogged only slightly up and down for wrapping a tie down end of yarn around the bottom of the package.

Customarily, the lowering of the ring rail to its doffing position after packages of processed yarn have been built on the spindles of the machine was accomplished manually by a foot pedal mechanism upon which an operator places his foot and presses down on the foot pedal under his own weight to lower the ring rail to a doffing position against the counterbalanced weight of the builder motion mechanisms. When allowing the ring rail to raise under the influence of the counterbalanced weight of builder motion mechanisms from the doffing position to the start-up position, the operator customarily controlled the speed of such upward movement of the ring rail by his foot on the foot pedal device. Also the jogging operation of the ring rail for start-up to remove slack, kinks and tails and to build a bunch of yarn or a tie down end of yarn around the bottom of the package was accomplished manually be the operator utilizing the foot pedal of the machine.

A large amount of pressure or weight is required for this manual lowering operation of the ring rail and the manual control of the speed of the raising operation of the ring rail and normally from about 100 – 200 pounds of pressure or weight is required for lowering the ring rail against the counterbalanced weight of the builder motion mechanisms. Obviously, the operator who manually lowers and raises the ring rail mechanism of a yarn processing machine of this type must be of sufficient size and strength to exert this amount of pressure or weight and this type of manual operation has normally precluded the use of female or small operators.

The moving of the yarn guide mechanisms from their processing position to their doff position has customarily heretofore been performed manually by the operator during doff and start-up operations. Also, the rewinding of the builder motion mechanisms has customarily heretofore been performed manually by the operator when the ring rail is in the doff position thereof by a lever inserted into such builder motion mechanisms for manually rewinding thereof.

The above described prior conventional operations during doffing and starting-up of yarn processing machines of this type and the customary preparation of the various elements of the machine for the doff and start-up operations are well-known to those with ordinary skill in the art and further explanation and description thereof is not believed necessary herein for a background of the present invention.

Although the above-described manual operations or the more customary and conventional, various mechanisms have heretofore been proposed for aiding the operator or at least partially automating these manual operations necessary for doffing and starting-up of the yarn processing machine. However, these previously proposed mechanisms have all been generally unsatisfactory due to the failure to perform desired functions, lack of the proper control on the sequential positioning of the various machine elements during their operations, their complicated and cumbersome construction and operation, and their lack of uniformity in the doff and start-up operating sequences, etc.

For example, the following prior art patents suggest devices for aiding the operator in lowering of the ring rail during doff and start-up operations:

| U.S. Patent No. | Inventor | issue Date |
|---|---|---|
| 2,503,099 | Culbreath | April 4, 1950 |
| 2,798,356 | Christiansson | July 9, 1957 |
| 3,080,701 | Kennedy et al | March 12, 1963 |
| 3,124,925 | Kennedy et al | March 17, 1964 |
| 3,175,350 | Powell et al | March 30, 1965 |
| 3,336,739 | Sanders et al | August 22, 1967 |
| 3,357,167 | Jones et al | December 12, 1967 |
| 3,566,598 | Godfrey | March 2, 1971 |

Of the above listed patents, U.S. Pat. No. 3,336,739, issued Aug. 22, 1967 is exemplary and suggest a pneumatically operated piston and cylinder mechanism which is non-positively connected by a flexible chain to the crank arm of the builder motion mechanisms of the textile yarn processing machine disclosed therein for aiding in lowering of this ring rail during doff and start-up operations. The flexible non-positive connection between the air operated piston and cylinder and the builder motion mechanism crank arm would operate only to assist in moving the crank arm and thus the ring rail in the lowering direction and could not operate to assist movement of or control the speed of raising of the ring rail. While movement of the crank arm for lowering of the ring rail against the weight of the builder motion mechanism is primarily desired, it would also be necessary in a mechanism of this design to control the speed of upward movement of the ring rail under the counterbalance weight of the builder motion mechanisms or to assist and provide a positive force for upward movement of the ring rail mechanisms, particularly in the case of older yarn processing machines which have worn bearings or operating parts thereof.

The mechanisms suggested by this prior U.S. Pat. No. 3,336,739 and the other prior art patents listed above would not function to control the speed of upward movement of the ring rail or to assist in providing a positive force for upward movement of the ring rail. Therefore, in the absence of a foot pedal device and manual operation by an operator to control the speed of upward movement of the ring rail under the influence of the counterbalanced weighted builder motion mechanism, damage to the machine, ring rail and other operating parts would probably occur during upward movement of the ring rail.

Mechanisms have also been suggested for pivotally moving yarn guide devices in textile yarn processing machines of the type considered herein between processing and doffing positions, such as illustrated in the following prior art patents:

| U.S. Patent No. | Inventor | Issue Date |
|---|---|---|
| 1,549,288 | Borovoy | August 11, 1925 |
| 1,796,390 | Owen | March 17, 1931 |
| 3,336,739 | Sanders et al | August 22, 1967 |

Of the above listed patents, U.S. Pat. No. 3,336,739 is exemplary and suggests pivotally mounted yarn guide mechanisms movable between a processing and doffing position by a pneumatically operated piston and cylinder device which is mounted stationary on the machine frame. With this arrangement, the yarn guides necessarily must also be mounted stationary and the pneumatic piston and cylinder arrangement of this patent would not function on the preferred vertically reciprocating yarn guide arrangements. The remaining patents disclose equally inefficient and undesirable yarn guide mechanisms.

Automatic devices for rewinding of builder motion mechanisms in yarn processing machines of the type considered herein have also been previously suggested, such as disclosed in the following prior art patents:

| U.S. Patent No. | Inventor | issue Date |
|---|---|---|
| 2,373,263 | Rowe | April 10, 1945 |
| 3,138,339 | Jones | June 23, 1964 |
| 3,336,739 | Sanders et al | August 22, 1967 |
| 3,524,311 | Browver | August 18, 1970 |

The builder motion rewind mechanisms of the above patents are all subject to problems of rewinding of the builder motion mechanisms in the middle of the build of a package of yarn when the yarn processing machine is stopped for correcting of some malfunction in the yarn processing. To overcome this problem, most of the prior automatic rewind mechanisms have included some positive clutch or electrical control device for operating the rewind mechanisms only when the ring rail is in its doff position. While these types of control devices for the automatic rewind mechanisms have overcome the above specific problem, they have presented other problems in the complicated designs of the automatic rewind mechanisms which have resulted in numerous malfunctions and the need for frequent repairs.

Although other mechanisms for aiding and at least partially automating the normal manual preparation of the elements of a textile yarn processing machine for doffing and starting-up may have been suggested, it is believed that the above listed prior art patents are representative of previously proposed mechanisms.

OBJECTS AND SUMMARY OF THE INVENTION

Accordingly, it is the object of this invention to overcome the above problems with the conventional manual operations of positioning of various elements of a yarn processing machine for doffing and starting-up and to overcome the problems presented by the previously proposed mechanical assist mechanisms for these positioning operations and to provide improved control apparatus for automating movements of various elements of the yarn processing machine for preparing the yarn processing machine for doffing of full packages of processed yarn and for starting-up of new packages of processed yarn.

By this invention, it has been found that the above object may be accomplished by providing such improved control apparatus in a textile yarn processing machine, such as spinning and twisting machines or the like, having a stationary frame, rotating yarn receiving spindles carried by the frame, a ring rail vertically reciprocated up and down about the spindles for guiding the yarn being processed onto bobbins carried by the spindles in predetermined patterns for building packages of processed yarn and builder motion mechanisms including a driven crank arm pivotally mounted on the machine frame and operatively connected with the ring rail for reciprocating pivotal movement thereof for reciprocating the ring rail in the predetermined patterns. The textile yarn processing machine may also include yarn guide devices associated with each of the spindles and which may vertically reciprocate up and down with the ring rail for guiding yarn to the ring rail and to the spindles during yarn processing.

The doff and start-up ring rail control apparatus of this invention for automating ring rail movements for doffing of full packages of processed yarn and start-up of new packages of processed yarn includes combinations and subcombinations of the following mechanisms.

Independent hydraulic fluid operated means are connected to the builder motion mechanisms of the machine and include a hydraulically operated piston and cylinder positively connected between the crank arm and the frame for relative reciprocating movement with respect to each other during reciprocating movements of the crank arm and the ring rail and cooperating with the builder motion mechanisms of the yarn processing machine for sequentially (1) lowering the ring rail to a doffing position below the bobbins on the spindles, (2) assisting the ring rail to raise under the influence of the builder motion mechanisms to a yarn processing position near the bottom of the bobbins on the spindles by at least controlling the speed of the raising of the ring rail, and (3) lowering and jogging the ring rail up and down adjacent the bottom of the bobbins on the spindles for removing slack and for bunch or wrap building of the yarn during start-up.

An electrical circuit control means is connected with the fluid operating means for being actuated to control the fluid operated means through the operating sequences thereof.

The positive, preferably non-flexible, connection between the piston and cylinder of the hydraulic fluid operated means and the crank arm of the builder motion mechanisms allows positive movement of the ring rail in response to positive relative movement of the piston and cylinder or vice versa which was not possible in previously suggested mechanisms. This arrangement allows positive movement of the ring rail in both a downward and an upward direction by the hydraulic fluid operated means, if desired, and/or speed control of the ring rail in the upward direction.

The ring rail controlling fluid operated means further preferably includes a source of hydraulic fluid, conduit means connected from the fluid source to the piston and cylinder for allowing the flow of fluid therethrough to and from the piston and cylinder during the relative reciprocating movements of the piston and cylinder, an electrically driven pump means controlled and activated by the electrical circuit control means for selectively pumping fluid under pressure from the source to the piston and cylinder for positively moving the crank arm and thus the ring rail for at least lowering the ring rail during the doff and start-up operating sequences, and flow restricting means connected in the conduit means for at least restricting the flow of fluid from the piston and cylinder during raising of the ring rail for controlling the speed of raising the ring rail.

The conduit means of the fluid operated means may comprise first and second conduit means respectively connected from the fluid source to each side of the piston and cylinder for allowing the flow of fluid therethrough to and from the piston and cylinder during the relative reciprocating movement of the piston and cylinder. The flow restricting means may be connected in each of the conduit means for regulating the flow of fluid therethrough and thus the speed of reciprocating movement of the ring rail during raising and lowering thereof. The ring rail controlling fluid operated means may also include a solenoid operated valve positioned in the first and second fluid conduits for selectively allowing the flow of pump hydraulic fluid through the first and second conduits for positively raising and lowering of the ring rail upon selected positioning of the valve. The solenoid operated valve is connected with the electrical circuit control for being controlled and actuated thereby.

The electrical circuit control means preferably includes a source of electrical energy, an electrical circuit connected between the source of electrical energy and the ring rail controlling fluid operated means for operating same, and a manually actuated switch means connected in the electrical circuit for being closed and opened for controlling the fluid operated means through the operating sequences thereof.

The electrical circuit control means may preferably additionally include a first switch means for being actuated upon the positioning of the ring rail in a desired position, preferably automatically actuated by the ring rail upon positioning thereof in its uppermost position at the completion of the building of a package of processed yarn on each of the spindles, timing means electrically connected with the first switch means for being initially actuated thereby upon actuation thereof and including a timing motor and a plurality of cams connected with and driven by the timing motor and cam switch means associated with each of the cams for actuation thereby and being electrically connected with the fluid operated means for timed actuation and deactuation thereof and with the timing motor for maintaining actuation thereof for a predetermined time period after initial actuation of said timing means by the first switch means for automatically controlling a desired portion or all of the sequential operations of the ring rail controlling fluid operated means, and second switch means for being actuated upon the positioning of the ring rail in the bunch or wrap building position during start-up and being electrically connected with the ring rail controlling fluid operated means for predetermined sequential actuation and deactuation thereof for jogging the ring rail and being electrically connected with the timing means for deactuation thereof at a predetermined time period to end the bunch or wrap building.

The electrical circuit control means may further preferably include a selector switch means connected with the ring rail actuated first switch means, the timing means and the ring rail actuated second switch means and connected with the manually actuated switch means for being selectively positioned for activating either an automatic sequential operation or a manual sequential operation of the ring rail controlling fluid operated means.

The electrical circuit control means further preferably may include switch means for being closed upon positioning of the builder cam of the builder motion mechanisms in a desired position after actuation of the ring rail actuated first switch means and which is connected with the timing means for allowing operation thereof after being closed by the builder cam to ensure that the sequential operation of the ring rail controlling fluid operated means commences with the ring rail in a desired position and preferably at the midpoint of the completed package of yarn so that, when yarn is withdrawn from the completed package during subsequent utilization of the built packages of processed yarn, withdrawal of the yarn will begin at the middle of the package of processed yarn to prevent sloughing off of one or more layers of built yarn from the package.

The doff and start-up ring rail control apparatus of this invention may also include latch means for automatically latching and holding the ring rail in the doff position thereof when the ring rail reaches such position and for automatically releasing the ring rail upon start-up. The latching means preferably includes a latch member pivotally mounted on the machine frame for movement to and from a latching position in engagement with the ring rail when in its doffing position, and solenoid means connected with the latch member and with the electrical circuit control means for being actuated and deactuated thereby for moving the latch member.

The doff and start-up ring rail control apparatus of this invention may also further include yarn guide means associated with each of the spindles for guiding yarn through the ring rail and to the spindles during yarn processing which includes a yarn guide positioned generally above each of the spindles, means commonly pivotally mounting each of the yarn guides on the machine frame for pivotal movement to and from a yarn processing position generally axially above the spindles to and from a doffing position generally away from the axes of the spindles for doffing of the spindles, and hydraulic fluid operated means connected to the mounting means of the yarn guides and with the ring rail controlling fluid operated means for being operated thereby for moving the yarn guides to and from the processing and doffing positions thereof. The yarn guides preferably include means for vertical reciprocation thereof up and down with the ring rail. The yarn guide controlling fluid operated means preferably comprises a hydraulic fluid operated piston and cylinder mounted for vertical reciprocating movement up and down with the yarn guides and being operatively connected to the yarn guide mounting means, and flexible conduit means respectively connected from the ring rail controlling fluid operated means to the yarn guide controlling piston and cylinder for moving the yarn guides between the positions thereof.

The builder motion mechanisms of the textile yarn processing machine, in accordance with this invention, preferably include automatic rewind mechanisms which, as will be described specifically hereinafter, automatically rewind the builder chain thereof only when the ring rail is positioned in the doff position to avoid manual rewinding and to avoid the necessity for positive actuation of the rewind mechanism by a clutch or the like and completely automate the builder motion mechanism of the machine.

Other specific features of preferred embodiments of the present invention will be seen from the more detailed description to follow. However, it may be seen from the broad description set forth above that this invention has provided control apparatus for automating movements of various elements of the yarn processing machine for preparing the yarn processing machine for doffing of full packages of processed yarn and for start-up of new packages of processed yarn and which overcome the problems presented with the conventional prior manual operations of these various elements and the problems presented with previously proposed automatic and semi-automatic assist mechanisms.

BRIEF DESCRIPTION OF THE DRAWINGS

Some of the objects and advantages of this invention having been stated, other objects and advantages will appear as the description proceeds when taken in conjunction with the accompanying drawings, in which --

DESCRIPTION OF PREFERRED EMBODIMENTS

Figure 1:
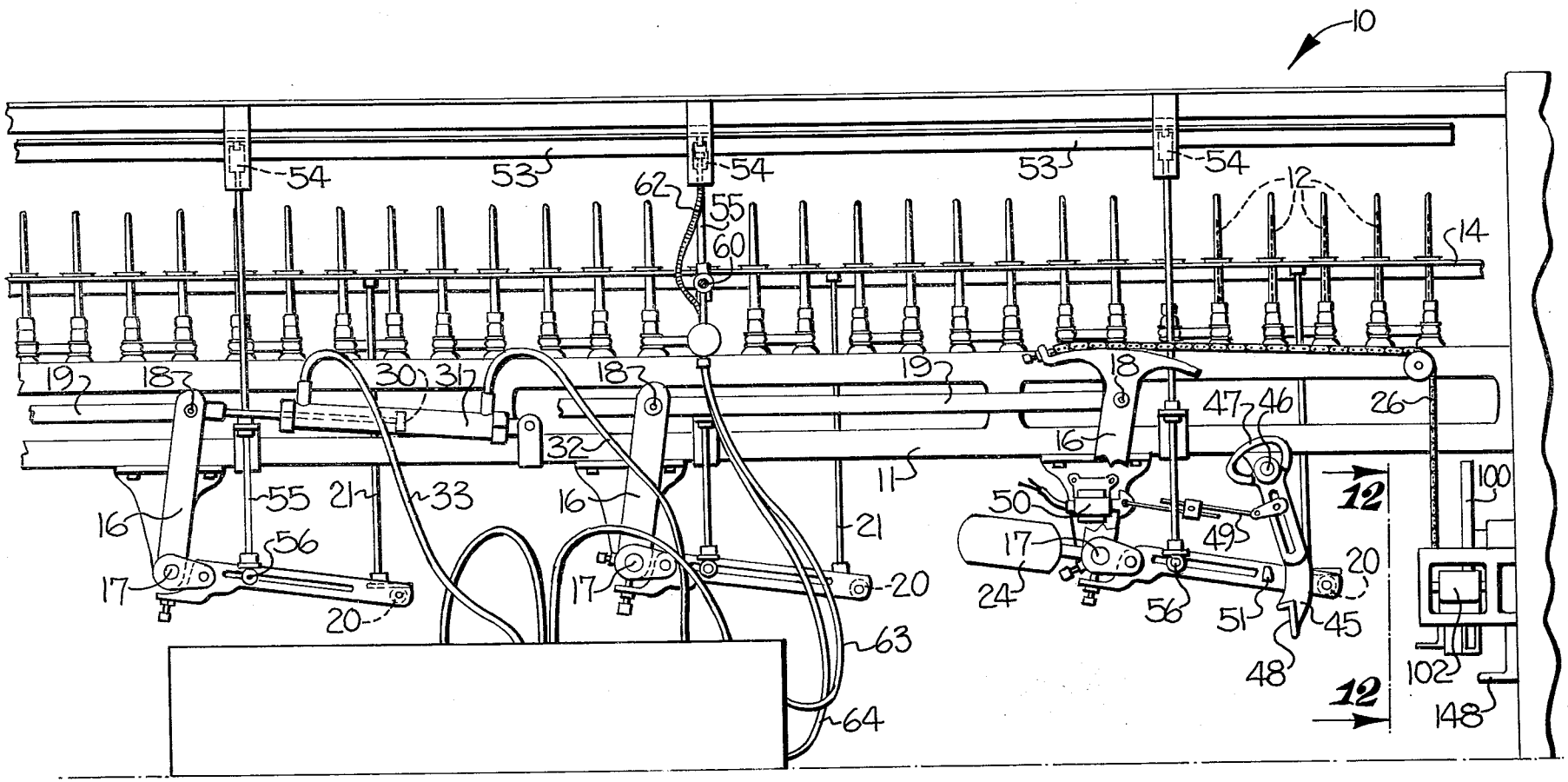
FIG. 1 is a partial elevational view, with some parts broken away, of one row of yarn processing spindles, taken generally from the inside of a textile yarn processing machine and including the improved control mechanisms of this invention.

Referring now to the drawings, a portion of a single yarn processing machine 10, such as a spinning or twisting frame or the like, is illustrated in FIG. 1 and includes a stationary frame collectively indicated at 11, a plurality of rotating spindles 12 carried by the frame 11 for receiving bobbins thereon for the winding of yarn Y during processing of the yarn by the machine 10. The machine 10 further includes a ring rail 14 which is vertically reciprocated up and down about the spindles 12 for guiding of the yarn Y being processed in a well-known manner onto the bobbins contained on the rotating spindles 12 in predetermined patterned layers of yarn Y for building a package of processed yarn on each of the spindles 12. As is well-known to those with ordinary skill in the art, these packages of yarn Y are built by progressive layers of yarn, less than the length of the spindle 12, by starting generally at the bottom of the bobbins on the spindles 12 and progressing upwardly to form a built package of yarn Y generally in the shape illustrated in the drawings herein. However, other shaped packages of yarn Y can be built, as desired.

Figure 4:
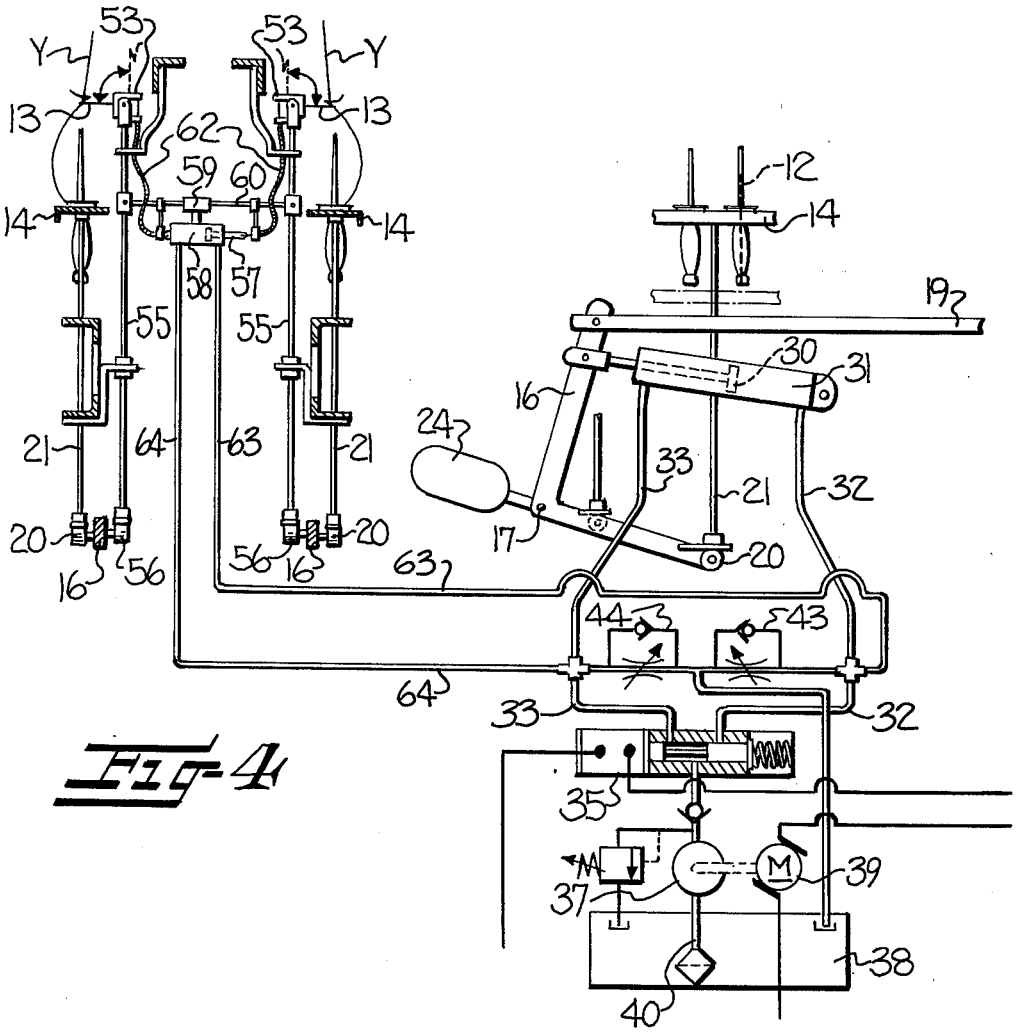
FIG. 4 is a schematic, electrical and mechanical diagram illustrating the preferred thread guide mechanism and the control mechanisms therefor in accordance with this invention.

The machine 10 further includes yarn guide devices 13 which are generally pigtail shaped, as shown particularly in FIG. 4, and are associated with each of the spindles 12 and may be mounted for vertical reciprocating movement up and down with the ring rail 14 for guiding yarn Y to the ring rail and to the bobbins on the spindles during yarn processing. The machine 10 also includes builder motion mechanisms connected with the ring rail 14 for reciprocating the ring rail 14 up and down about the spindles in the predetermined patterns during normal yarn processing. These builder motion mechanisms include a plurality of crank arms, the elements of which are collectively indicated at 16, pivotally mounted at 17 onto a part of the stationary frame 11. The crank arms 16 are connected at one end 18 to a common connecting rod 18 and abutt at their other end 20 with one end of ring rail lifter rods 21 which are connected at their outer ends to ring rail 14. At least one of the crank arms 16 includes a counterbalance weight 24 extending outwardly from the pivot point 17 for biasing the crank arm 16 into a position for lifting the lifter rods 21 and the ring rail 14 in an upward vertical direction.

For counteracting the bias of the counterbalance weight 24 and allowing the ring rail to move down by its own weight under the influence of gravity about the spindles 12 during its reciprocating operation, a builder motion chain 26 is connected to one end of at least one of the crank arms 16 and is driven by the other builder motion mechanisms, to be described below, to reciprocate the chain 26 back and forth and move the crank arms 16 in the opposite direction to which they are biased by the weight 24 to allow the ring rail 14 and lifter rods 21 to move down by their own weight under the influence of gravity for the downward reciprocating motion. The chain 26 is let out or extended in length an incremental amount during each reciprocating movement so as to reciprocate the ring rail 14 up and down about the spindles 12 in incremental advancing back and forth patterns of movement starting from the bottom of the spindles 12 and culminating at the top of the spindles 12.

While the drawings illustrate only one side of a typical yarn processing machine, it is to be understood that a row of rotating spindles 12 are normally disposed on the other side of the yarn processing machine 10. Also, other mechanisms of the typical yarn processing machine, such as the devices for rotating the spindles 12, are not being described herein as they are not necessary for a complete understanding of the present invention. Their operation and function are well-known by those with ordinary skill in the art. Also, the above-described conventional mechanisms of a typical spinning or twisting machine and their operation for processing of yarn are also well understood by those with ordinary skill in the art and further explanation and detailed illustration, other than that given hereinafter, is not deemed necessary for an understanding of the present invention.

Figure 10:
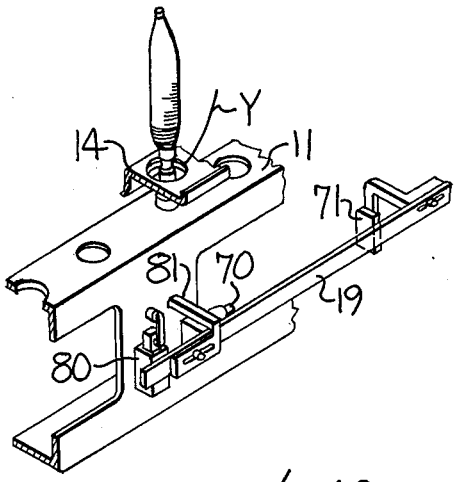

After the packages of processed yarn Y have been built on the spindles 12 of the machine 10, the ring rail 14 must be moved to a position (shown in FIGS. 6 and 10) lower than a normal operating position during yarn processing, the yarn guide devices 13 must be moved to a doff position out of axial alignment with the spindles 12 (shown in dotted lines in FIG. 4) so that the completed packages of processed yarn Y may be automatically or manually removed or doffed from the spindles 12. Also, when the ring rail is placed in the doff position, the builder motion mechanisms must be rewound to rewind the slack presented in the chain 26 due to positioning of the ring rail 14 in its lower position, and the ring rail must be latched in its lower position to hold the ring rail 14 in the lower position during doffing.

Figure 7:
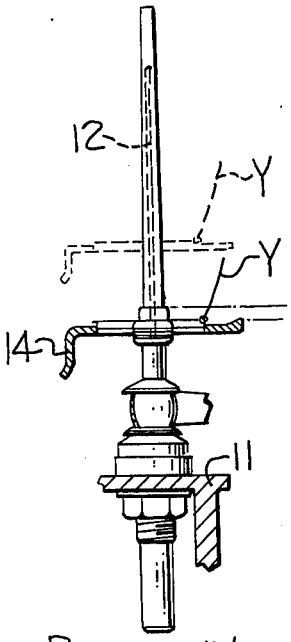
Figure 11:
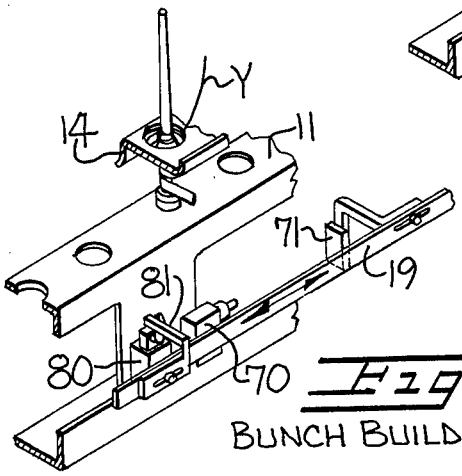
Figure 12:
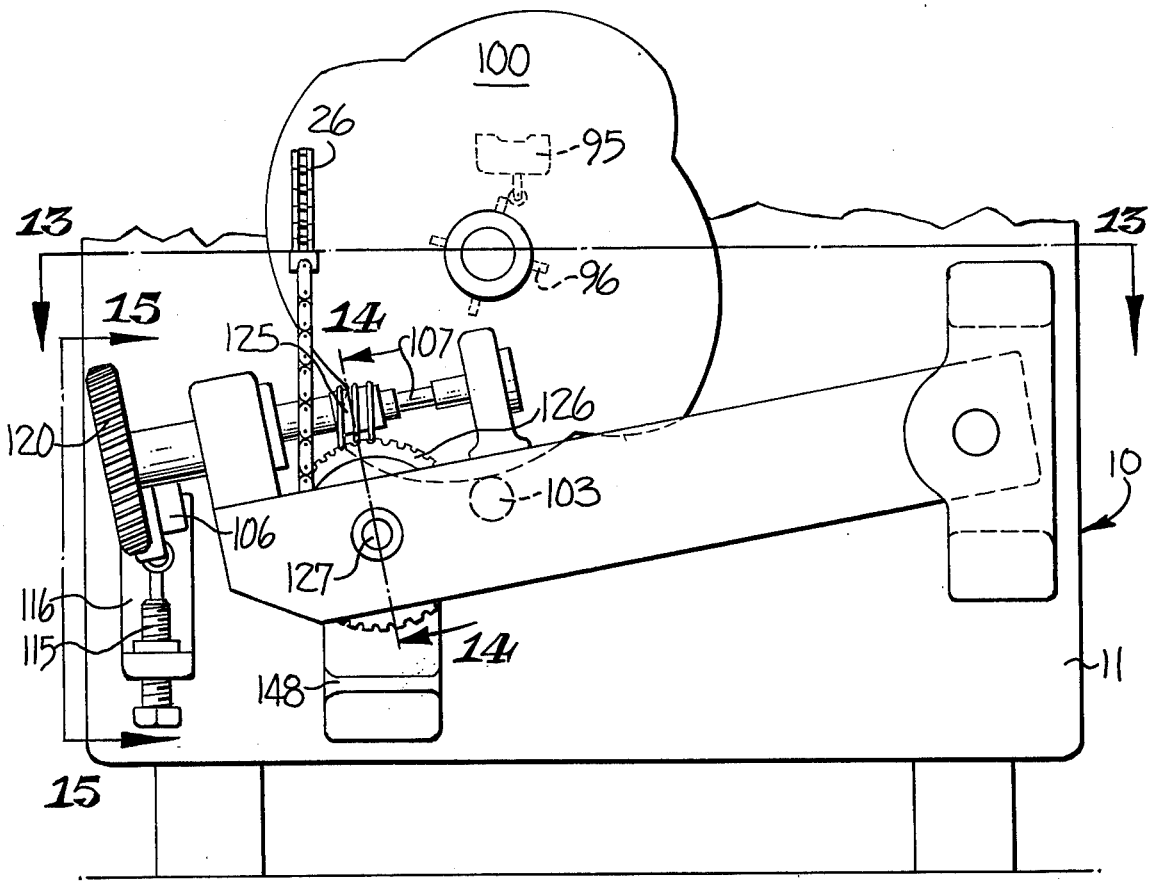
FIG. 12 is a sectional view of a portion of the improved builder motion mechanisms, taken generally along the line 12—12 of FIG. 1.
Figure 13:
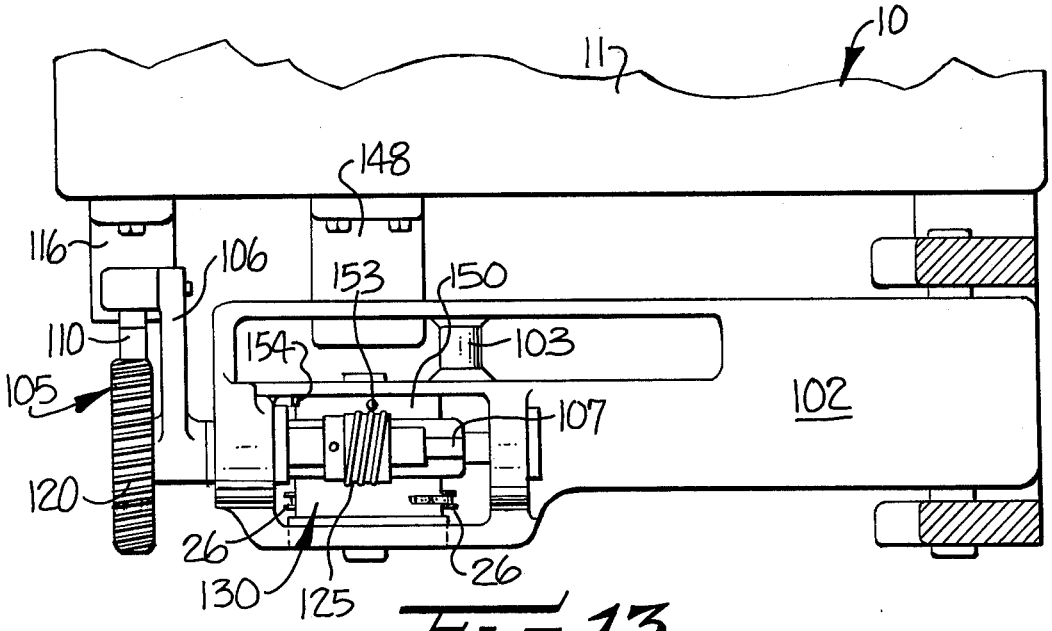
FIG. 13 is a sectional view, taken generally along the line 13—13 of FIG. 12.

Thereafter, the ring rail must be raised to the lowest normal operating position at generally the bottom of the bobbins on the spindles 12 (as shown in FIGS. 7 and 11) and must be jogged up and down for removing slack, kinks and yarn tails and for bunch building of the yarn adjacent the lower ends of the bobbins on the spindles. If a tie down wrap is desired instead of a bunch build the ring rail will be held or jogged only slightly after removal of the slack, kinks and yarn tails. Also, during such start-up operations, the yarn guides 13 must be moved back to their normal operating positions axially above the spindles 12 (as shown in solid lines in FIG. 4).

For accomplishing the above sequential positioning of these elements of the yarn processing machine 10 and eliminating the necessity for manual foot pedal operations by the operator, control apparatus for automating movements of these various elements of the yarn processing machine 10 for preparing the yarn processing machine for doffing of full packages yarn Y and for starting-up of new packages of processed yarn Y is provided in accordance with this invention. The control apparatus in accordance with this invention may constitute a complete automatic doff preparation unit or only certain elements and combinations of elements may be used to provide automation for the desired doff and start-up preparation. The control apparatus of this invention is designed to prepare the yarn processing machine for manual or automatic doffing and for restarting of the yarn processing machine after such doffing.

Figure 2:
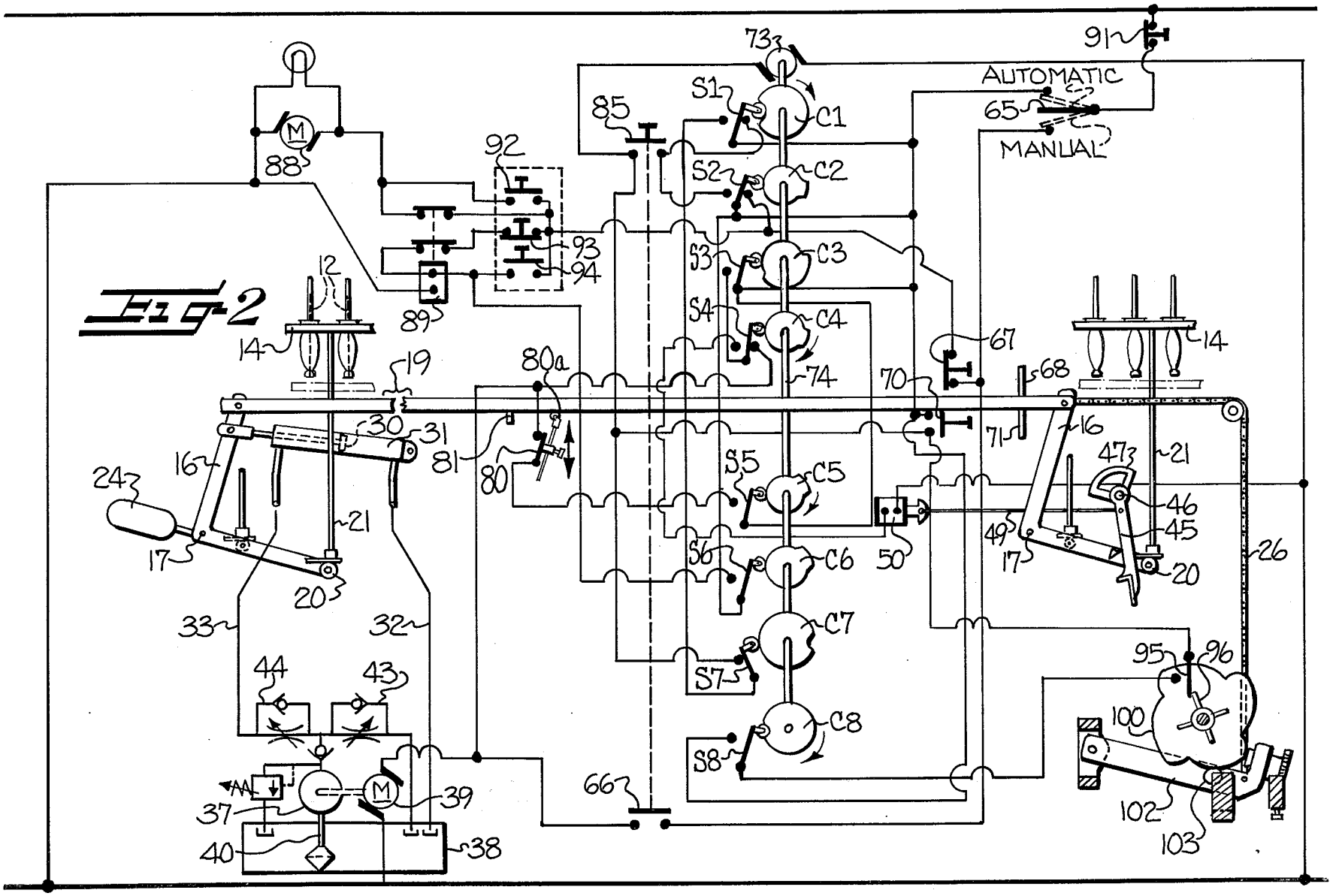
FIG. 2 is a schematic, electrical and mechanical diagram illustrating combinations of the improved mechanisms of this invention.
Figure 3:
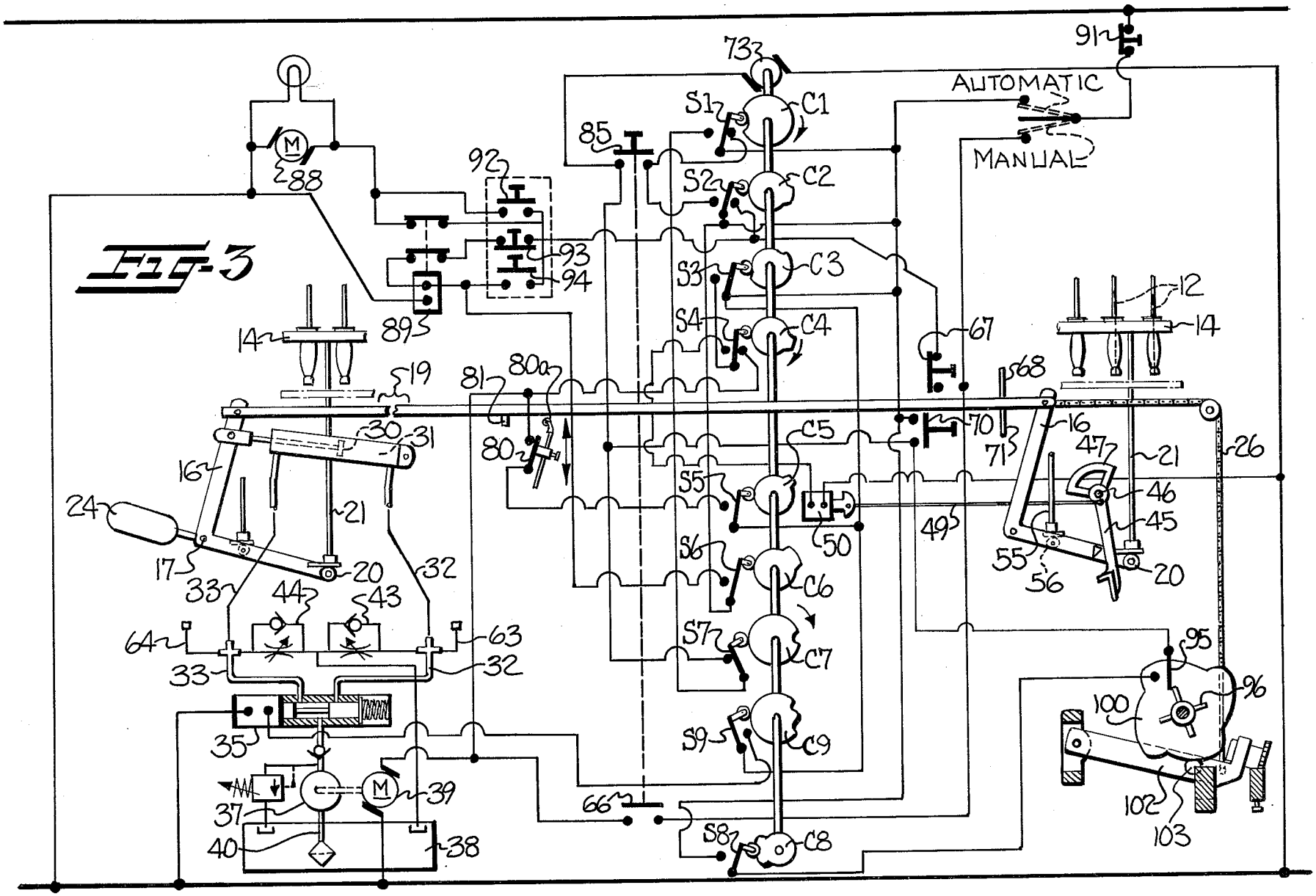
FIG. 3 is a schematic, electrical and mechanical diagram, like FIG. 2, illustrating other combinations of the improved mechanisms of this invention.

In FIGS. 2 and 3 of the drawings there are illustrated different forms or embodiments of the control apparatus of this invention including various optional features in each. However, for ease of understanding, these embodiments of FIGS. 2 and 3, with the optional features of each, will be described together and like reference numerals will be used on the drawings for the like or equivalent components in each of these embodiments.

Figure 8:
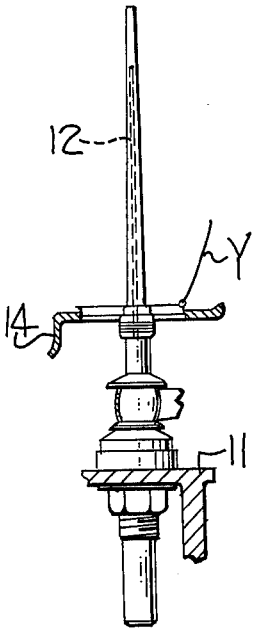
Figure 9:
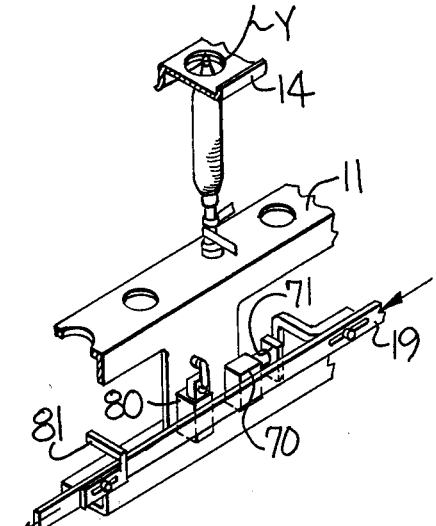
FIGS. 9–11 are schematic perspective views illustrating the ring rail in various positions with respect to various operating sequences and actuation of certain switches of the electrical control circuit of the apparatus of this invention.

For the above purposes, the doff and start-up control apparatus of this invention includes independent hydraulic fluid operated means, as will be described fully below, connected to the builder motion mechanisms and operated by an electrical circuit control, as described below, for sequentially (1) lowering the ring rail 14 from a full package position, see FIG. 5, to a doff position, see FIG. 6, for doffing of the built and completed package of processed yarn Y from the spindles 12, (2) after doffing, assisting the ring rail 14 to raise under the influence of the builder motion mechanisms including the counterbalance weight 24 to a yarn processing position near the bottom of the bobbins on the spindles, see dotted line position of FIG. 5, by at least controlling the speed of the raising of the ring rail by the builder motion mechanisms, (3) lowering and jogging the ring rail up and down adjacent the bottom of the bobbins on the spindles for removing slack and for bunch or wrap building of the yarn during start-up, see FIG. 7, and (4) releasing the ring rail 14 for control by the builder motion mechanisms for normal yarn processing operations, see FIG. 8.

This hydraulic fluid operated means comprises a piston and cylinder device 30, 31 in which the piston 30 is directly and positively connected to one of the crank arms 16 and the cylinder 31 is directly and positively connected to a portion of the stationary frame 11. By this positive, non-flexible connection between the frame 11 and the crank arm 16, the piston and cylinder 30, 31 will be reciprocated with respect to each other during each reciprocating movement of the crank arm and the ring rail, which would not occur with a non-positive, flexible connection.

The ring rail controlling fluid operated means further includes a source of hydraulic fluid 38 (indicated schematically in FIGS. 2 and 3), conduit means 32, 33 connected from the fluid source 38 to the piston and cylinder 30, 31 for allowing the flow of fluid therethrough to and from the piston and cylinder 30, 31 during the relative reciprocating movements of the piston and cylinder 30, 31. A pump 37 is driven by an electrical motor 39 and receives hydraulic fluid from supply source 38 by a conduit 40. Flow restricting valve means 43, 44 are connected in the conduit means 32, 33 for at least restricting the flow of fluid from the piston and cylinder 30, 31 during raising of the ring rail for controlling the speed of the raising of the ring rail.

Referring specifically to the embodiment of FIG. 2, the pump 37 is arranged for pumping fluid from the source 38 upon actuation of the motor 39 through conduit 33 and to the rod end of the piston 30 in the piston and cylinder 30, 31 for moving the crank arm 16 and thus the ring rail 14 to a lower or doffing position. When the ring rail is raised by the builder motion mechanisms including the counterbalance weight 24, the fluid will be forced back through conduit 33 and the flow restricting valve means 43, 44 to the source 38. The flow restricting valve means can be adjusted for regulating and controlling the speed of the upward movement of the ring rail 14 and thus assist the ring rail to raise under the influence of the builder motion mechanisms to a yarn processing position. The flow restricting valve means 43, 44 may also be utilized and adjusted for regulating the speed of the positive lowering of the ring rail by regulating the speed of flow of the hydraulic fluid from the pump through the conduit 33. In this embodiment, the conduit 32 is used merely as a drain for fluid leaking around the piston 30 in the cylinder 31.

Thus, in the specific embodiment of FIG. 2, fluid is pumped to the piston and cylinder mechanism 30, 31 for positively moving the ring rail 14 in the lowering direction and the flow restricting valve means 43, 44 are utilized for controlling the speed of raising of the ring rail under the positive movement of the builder motion mechanisms.

Referring now specifically to the embodiment of FIG. 3, the ring rail controlling fluid operated means further includes a solenoid operated valve 35 positioned in both of the fluid conduits 32, 33 for selectively allowing the flow of pumped hydraulic fluid through one or the other of the conduits 32, 33 to either the rod end of the piston 30 or to the piston end of the piston 30 for positively lowering and raising of the ring rail 14 by positive relative movement of the piston and cylinder 30, 31 by pumped hydraulic fluid. The flow restricting valves 43, 44 also act for controlling the speed of this positive lowering and raising movement by regulating the flow of fluid through the conduits 32, 33.

The control apparatus for automating movements of various elements of the yarn processing machine 10 further includes a latch means for automatically latching and holding the ring rail in the doff position when the ring rail 14 reaches such position and for automatically releasing the ring rail upon start-up. This latch means comprises a latch member 45 pivotally mounted at 46 to a portion of the machine frame 11 and includes a counterbalance weight 47 on one end thereof and a latching element 48 on the other end thereof. The latching element 48 on the latch member 45 engages a projection 51 extending outwardly from one of the crank arms 16 when the ring rail has been lowered to its off position for holding the crank arm 16 and thus the ring rail 14 in the off position. The latch member 45 is connected by a rod device 49 at an intermediate portion thereof to an electrically actuated solenoid 50 for moving the latch member 45 against the counterbalance of its weight 47 when actuated from a non-latching position to a latching position.

The yarn processing machine 10 may further include generally pigtail shaped yarn guide devices 13, as mentioned above, which are preferably mounted for vertical reciprocating movement up and down with the ring rail 14 for guiding yarn Y to the ring rail and to the spindles 12 during yarn processing. For this purpose, the pigtail yarn guide devices 13 are commonly mounted on rails 53 which are in turn pivotally mounted on brackets 54 attached to one end of lifter rods 55 which pass through and are stabilized by a portion of the stationary machine frame 11 and have their other ends resting on and engaged by a projection 56 suitably secured to the crank arm 16 so that the yarn guide devices 13 will be reciprocated up and down with the ring rail 14 during reciprocating movement thereof by the crank arm 16. Inasmuch as the rail 53 is pivotally mounted on the bracket 54, the yarn guide devices 13 may be pivoted to and from a normal yarn processing position (shown in solid lines in FIG. 4) in which the yarn guides are positioned axially above each of the spindles 12, to and from a doffing position (shown in dotted lines in FIG. 4) in which the yarn guides are pivotally moved away from the axis of the spindles 12 for doffing of full packages of processed yarn Y from the spindles 12.

For effecting such movement of the yarn guide devices 13 between such positions there is provided hydraulic fluid operated means connected with the ring rail controlling fluid operated means for being operated thereby for moving the yarn guides 13 to and from the processing and doffing positions thereof in relation to the positions of the ring rail 14. This yarn guide controlling fluid operated means comprises a floating hydraulic fluid operated piston and cylinder 57, 58 which is carried by a slide 59 on a rod 60 secured to the lifted rods 55. The rod 60 extends between lifter rods 55 on each side of the machine 10 and adjacent each of the rows of spindles 12. Thus the hydraulic piston and cylinder 57, 58 will also vertically reciprocate up and down with the yarn guides 13 and with the ring rail 14.

The hydraulically operated piston and cylinder device 57, 58 is respectively connected at the ends thereof to flexible cable and sheath devices 62 leading to and connected with ring rails 53 of the yarn guide devices on each side of the machine 10 so that when the piston and cylinder 57, 58 move relative to each other, the yarn guides 13 will be pivoted between their yarn processing and doffing positions by contraction and expansion of the flexible cable and sheath devices 62 causing pivotal movement of the mounting rails 53.

The yarn guide controlling fluid operated means further includes flexible fluid conduits 63, 64 leading from opposite sides of the cylinder 58 and being respectively connected with the conduits 32, 33 of the ring rail controlling fluid operated means for being operated thereby through the pumping of hydraulic fluid from the source or reservoir 38 by the pump 37 through the solenoid operated valve 35.

The control apparatus for automating movements of various elements of the yarn processing machine 10 further include an electrical circuit control means, as mentioned above, which is connected with the ring rail controlling fluid operated means and, if utilized, may be connected with the yarn guide controlling fluid operated means and with the ring rail latch means for being actuated to control the desired sequential positioning of the ring rail 14, the latch member 45, and the yarn guides 13, as desired, for doffing and starting-up of the yarn processing machine 10. The electrical circuit control means, as shown in FIGS. 2 and 3, comprises generally a source of electrical energy and an electrical circuit connected between the source of electrical energy and the ring rail controlling fluid operated means including the pump motor 39 and the solenoid actuated valve 35 of the embodiment of FIG. 3, along with the latch member solenoid 50 for controlling these mechanisms through the operating sequences thereof.

The electrical circuit control means further includes a two position selector switch 65 connected in the electrical circuit between the source of electrical energy and the pump motor 39 so that, when the selector switch 65 is positioned in the manual position thereof (as indicated in FIGS. 2 and 3), a manually operated electrical circuit will be activated through manually operated switch 66 to the pump motor 39 for providing a manually operated electrical circuit control means by which raising and lowering of the ring rail 14 can be controlled by an operator by opening and closing of the switch 66 manually. With the use of this manual circuit, the sequence of operation of the raising and lowering of the ring rail will be controlled by an operator.

The selector switch 65 may also be positioned in the Automatic position thereof which actuates an electrical circuit, in parallel with the manual circuit, for automatic or semiautomatic sequential operation of the raising and lowering of the ring rail 14 and the other elements of the yarn processing machine as will be described below.

Figure 5:
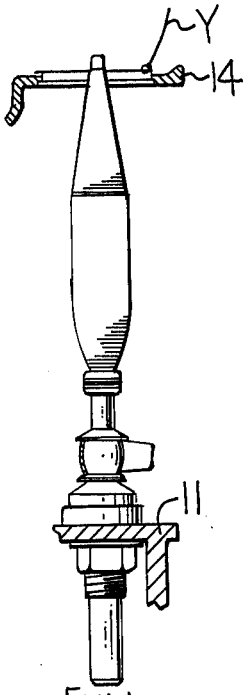
FIGS. 5–8 are enlarged, elevational views of a single spindle illustrating the ring rail in the various positions related to the operating sequences of the apparatus of this invention.

The automatic circuit of the electrical circuit control means includes a first, normally open switch 70 positioned for being automatically actuated upon the positioning of the ring rail 14 in its uppermost position at the completion of the building of a package of processed yarn Y on each of the spindles 12 (FIG. 5). For this purpose, the switch 70 may be manually closed by an operator upon the building of a package of yarn being completed or may be actuated by a wand 71 extending from the crank arm connecting rod 19 for engagement with the switch 70. As may be seen in FIGS. 2 and 3, as the builder motion chain 26 is let out incremental amounts during the progressive building of processed yarn packages on the spindles 12, the connecting rod 19 will be reciprocated progressively more and more to the left, as viewed in FIGS. 2 and 3. When the ring rail has moved to its upper full package position (FIG. 5), the connecting rod 19 and wand 71 will have moved to a position to bring the wand 71 into engagement with the switch 70 for closing the switch 70 and energizing the automatic electrical circuit through the normally open switch 70.

The automatic circuit of the timed electrical circuit control means further includes timing means electrically connected with the first switch means 70 for being initially actuated thereby upon actuation of the switch 70 and includes an electrically operated timing motor 73 which includes a shaft 74 extending therefrom and rotatably driven thereby. The timing means further includes a plurality of cams mounted on and rotated by the timing motor shaft 74, and as illustrated in FIG. 2 includes eight cams C-1 through C-8, and as illustrated in FIG. 3 includes nine cams C-1 through C-9. Any desired number of cams may be provided for performing desired functions. These cams each include a two position switch S-1 through S-8 as shown in FIG. 2, and S-1 through S-9 as shown in FIG. 3, associated therewith and each having a follower thereon for resting against the profile of the cams for actuation and deactuation of two electrical circuits connected with associated contacts of each of the two position switches. The cam controlled two position, switches are suitably electrically connected, as shown in FIGS. 2 and 3, with the above-described pump motor 39, latch solenoid 50, fluid controlling solenoid valve 35, etc., for controlling the raising and lowering of the ring rail 14, pivoting of the yarn guides 13 and latching and unlatching of the latch member 45, etc.

The automatic circuit of the timed electrical circuit control means further includes a second switch means 80 suitably electrically connected with the normally closed circuit of cam operated switch S-4 and with the normally open circuit of cam operated switch S-5 and with the electrically operated pump motor 39 for being actuated upon the positioning of the ring rail 14 and the bunch or wrap building position during start-up, as shown in FIG. 7, for being sequentially actuated and deactuated for jogging the ring rail. The switch 80 is a normally closed switch and is controlled by a wand 81 extending downwardly from the connecting rod 19 for contacting and opening the normally closed circuit of switch 80 upon reciprocation of the ring rail 14 between the position indicated in FIGS. 2 and 3 to a position for engaging the wand 80*a* extending upwardly from the switch 80. The switch 80 is a pivoted switch which will only be moved to open the electrical circuit therethrough upon the wand 81 moving from left to right as viewed in FIGS. 2 and 3 inasmuch as the open portion of the switch 80 will pivot when the wand 81 contacts the switch when moving from right to left as viewed in FIGS. 2 and 3.

The distance between the position of the wand 81 and the position of the wand 80*a* of switch 80, as shown in FIGS. 2 and 3, would be varied for a bunch building operation or a tie down wrap operation. The switch 80 and wand 81 could be constructed adjustable for shortening or lengthening this distance or could be stationarily mounted at the desired distance apart for bunch building or tie down wrap building.

The automatic circuit of the timed electrical circuit control means further includes a normally open, manually or otherwise operated, push-button switch 85 suitably electrically connected between the timing motor 73 and the cam operated switches, to be described more specifically below. This switch 85 is utilized to activate the automatic circuit of the electrical control means after doffing of packages of processed yarn from the spindles 12 and when it is desired to initiate a start-up operation. There is further provided a main processing machine motor 88 which is controlled by holding switching relay 89 of any suitable design for operating the conventional spindle drive, the reciprocating builder motion mechanisms and other driven mechanisms of the yarn processing machine 10. Further, there is provided a normally closed switch 91 which constitutes a safety switch to deactivate the entire electrical control circuit, if desired. There is further provided a manually operated jogging switch 92, stop switch 93 and start switch 94 for manually overriding the automatic circuit of the electrical control means, if desired.

The selectable manual circuit described above may further include a normally closed switch 67 which is connected with relay 89 and the main machine motor 88. This switch 67 is controlled by a wand 68 extending from the connecting rod 19 for contacting and opening the switch 67 when the ring rail moves to the full bobbin position for stopping operation of the motor 88 and thus the machine 10.

In operation of the automatic circuit of the electrical control means, when the normally open switch 70 is closed, either manually or by the ring rail 14 when the ring rail 14 has moved to its full package position (FIG. 5) after the building of a full package of processed yarn Y on the spindles 12 which indicates that the spindles 12 are now ready for doffing, an electrical circuit is completed to the timing motor 73 for initially actuating this timing motor and thus starting rotation of the cams C-1 through C-8. The rotation of the cam C-8 will cause the switch S-8 to close the normally open circuit thereof.

After the indication that the spindles are ready for doffing and actuation of the switch 70, it is desired for the ring rail to be reciprocated downwardly one stroke of its normally building reciprocation and upwardly approximately one-half of its normal stroke of the final building operation by the builder motion mechanisms. The switch 70, during such movement of the ring rail, is immediately opened and the timer motor 73 stops since the switch S-1 has not yet closed the normally opened circuit thereof.

To insure that the ring rail has reciprocated downwardly one stroke of its normal building reciprocation and upwards approximately one-half of its normal building stroke prior to lowering of the ring rail to its doff position, so as to insure that when the yarn is unwound from this built package of yarn such unwinding begins in the middle of the built package as desired in subsequent operations, a switch 95 is positioned adjacent the builder cam 100, to be described more fully below, so as to be closed by appropriately positioned wands 96 when the builder cam is in the correct position in which the chain 26 has been let out a desired amount to position the ring rail 14 in the middle of the built package of yarn. The switch 95 is electrically connected to the switch S-8, which has been moved by the cam C-8 upon initial rotation of the shaft 74 by the timer motor 73, and to the timer motor 73 so that when the switch 95 is closed by correct positioning of the ring rail 14, the timer motor 73 will again be actuated for rotating cam C-1 to its proper position for closing the normally open circuit of switch S-1 to act as a holding circuit for the timer motor 73 to continue to rotate for a predetermined time period.

Closing of the normally open circuit by the switch S-1 provides electricity and activates the two position timing switches S-3, S-4, S-5, S-7 and S-9, if utilized.

The cam C-3 has now rotated sufficiently to move the switch S-3 to close the normally open circuit thereof. Electricity now flows through this closed circuit of switch S-3 and through the normally closed circuit of S-4 and to the electrically operated pump motor 39 to activate the pump 37 to pump fluid under pressure through the conduit 33 to the rod end of the piston-cylinder device 30, 31 to cause the ring rail to be lowered to its doff position (FIG. 6).

In the embodiment of FIG. 2, the pump fluid would flow directly through conduit 33 to the rod end of piston-cylinder device 30, 31 and in the embodiment of FIG. 3, the pumped fluid would flow through the valve 35 which is maintained in an actuated position shown in FIG. 3. Also, fluid would be pumped through the yarn guide conduit 64 to maintain the yarn guide piston-cylinder 57, 58 and the yarn guides 13 in their normal processing position, shown in FIG. 4. It is noted that the normally closed contact of switch S-3 is not used in the presently described control circuits.

As the ring rail 14 is being lowered to its doff position, the timing motor 73 causes all of the cams to rotate 180 degrees during which time the following functions take place.

In the control circuit of FIGS. 3 and 4, cam C-9 rotates to a position to allow the normally open circuit of switch S-9 to close providing electricity to the solenoid operated valve 35 for shifting this valve to allow fluid under pressure from pump 37 to flow through the conduits 32 and 63 to the floating yarn guide piston-cylinder device 57, 58 to cause the cable 62 to constrict and pivot the pigtail thread guides 13 to their doff position away from axial alignment with the spindles 12, as shown in dotted lines in FIG. 4. The normally closed contact of switch S-9 is not used in the circuits described herein.

Simultaneously, cam C-4 has closed the normally opened circuit of switch S-4 which activates the solenoid 50 of latch member 45 to pivot the latch member 45 into latching position for holding the ring rail 14 against the normal bias of the counterbalance weight 24 in its lower or doff position. Opening of the normally closed circuit of switch S-4 shuts off power to the pump motor 39 and thereby stops operation of the ring rail controlling fluid operated means.

Power to the main motor 88 through the relay is furnished by the normally closed circuit of cam operated switch S-2 and, as the ring rail reaches its lower or doff position, the cam C-2 opens the normally closed circuit of switch S-2 and the main frame motor coasts to a stop. This allows four or five turns of yarn Y to be wound around the spindles 12 underneath each bobbin for well-known purposes. Simultaneously, the normally open circuit of cam operated switch S-2 is closed which activates and furnishes electricity to the normally open, manually operated push-button switch 85 for purposes to be described below.

When the ring rail 14 has reached its doff position, the cam C-7 opens the normally closed circuit of switch S-7 which is connected in series with the closed, normally open circuit of switch S-1 to interrupt the flow of electricity and deactivate the motor 73 to stop operation thereof and to stop rotation of the cam C-1 through C-8. The normally open contact of switch S-7 is not used in the circuits described herein. Also, the cam C-9 has now rotated to open the normally open circuit of switch S-9 to deactivate solenoid valve 35, in the embodiment of FIG. 3, and allow it to return to its normal position.

The yarn processing machine 10 is now ready for doffing by an automatic doffing mechanism or manually by an operator. The ring rail 14 has been lowered to its doff position below the bobbins on the spindles 12 and the timed electrical circuit control means has timed out and been shut off. Also, the latch member 45 has latched the ring rail 14 in this lower doff position and the pigtail yarn guides 13 have been pivoted to their doff position out of axial alignment with the spindles 12 so that the completed packages of processed yarn Y may be doffed or removed from the spindles 12.

After doffing, the yarn processing machine 10 is now ready for its next cycle and bobbins or other carriers have been placed on each of the spindles 12 automatically or manually for the start-up of the yarn processing operation and the building of a new package of processed yarn on each of the spindles 12. The push-button switch 85 is now either manually closed or automatically closed by an automatic doffing and bobbin replenishing mechanism. The circuit of this push-button switch 85 has been previously activated by the closing of the normally open circuit of cam operated switch S-2, as described above. The push-button switch 85 is held closed which furnishes electricity to the timing motor 73 to again begin its operation and start rotation of the cams through the second 180° of their cycle of rotation. Immediately, cam operated switch S-7 closes the normally closed circuit thereof, which had been opened by cam C-7 at the end of the first 180° of rotation, to supply electricity through the normally open circuit which has now been closed by switch S-1 to keep the timing motor 73 running regardless of the position of the push-button switch 85 which may now be released.

The normally open circuit of cam operated switch S-6 is now closed to supply power through the relay 89 to the main machine motor 88 to again begin the normal operation of the yarn processing machine 10. The normally closed contact of switch S-6 is not used in the circuits described herein. Also, cam operated switch S-2 closes the normally closed circuit thereof, which had been previously opened, to provide the normal flow of power to the main machine motor 88 and allows the switch S-6 to open its normally open circuit without effecting the flow of power to the main machine motor 88.

During this second 180 degree rotation of the cams, cam C-4 has opened the normally opened circuit of switch S-4, which was closed at the end of the first 180 degree cycle of rotation of cam C-4, for closing the normally closed circuit to activate pump motor 39 to cause fluid to flow through conduit 33 to lower ring rail 14 to an unlatched position and for deactuating solenoid 50 and allowing the latch member 45 to pivot under the influence of counterbalance weight 47 to the non-latching position thereof. This allows ring rail 14 to begin to rise to a normal operating position thereof under the influence of counterbalance weights 24 on crank arm 16.

In the embodiment of FIG. 3, cam C-9 rotates to close the normally open circuit of switch S-9 to activate solenoid valve 35 for the flow of fluid through conduit 32 to ring rail controlling piston and cylinder 30, 31 for assisting upward movement of the ring rail 14 by exerting a positive upward force thereon. Thereafter, cam C-9 rotates to open the normally open circuit of switch S-9 to deactivate solenoid valve 35 and allow it to return to its normal position for allowing the flow of fluid through conduits 33 and 64 to the other side of yarn guide piston 57 and cylinder 58 to extend the cable 62 and pivot the pigtail guides 13 back to their normal yarn processing position axially above each of the spindles 12.

In the embodiment of FIG. 2, which does not utilize a solenoid valve 35, after actuation of the pump motor 39 to momentarily lower ring rail 14 to an unlatched position, cam C-3 has rotated sufficiently to open the normally open circuit of switch S-3 to stop the flow of electricity to the pump motor 39. The ring rail 14 rises under the influence of counterbalance weight 24 on crank arm 16 and causes movement of the piston 30 relative to the cylinder 31 so as to force fluid back down through the conduit 33 and the flow restricting valve means 43, 44 which acts to regulate the upward speed of movement of the ring rail 14 and thereby assist the builder motion mechanisms in raising of the ring rail 14.

The ring rail 14 now rises to a normal processing position for the first sequential up and down reciprocation for building of layers of yarn near the bottom of the bobbin on the spindles 12 and to the position generally indicated by the dotted lines in FIG. 7. Cam C-3 has rotated to open the normally open circuit thereof for deactivating pump motor 39; however, cam C-5 has rotated to close the normally open circuit thereof to supply electricity through the switch 80 to activate pump motor 39 for the flow of fluid through the conduit 33 to piston-cylinder device 30, 31 to again cause the ring rail 14 to move downwardly by pivoting of the crank arm 16. The normally closed contact of switch S-5 is not used in the circuits described herein. This downward movement of the ring rail 14 removes slack, kinks and yarn tails in the yarn Y being started-up on each of the spindles 12 and causes the wand 81 to open the switch 80 when the ring rail reaches the lower portion of the bunch or wrap building position, the lower bunch building position being indicated in solid lines in FIG. 7. When the switch 80 is opened, power to the pump motor 39 is shut off and the ring rail again starts upwardly under the influence of the counterbalance weights 24 on the crank arm 16. This causes the wand 81 to again close the switch 80 and thereby reinstate power to the pump motor 39 and the ring rail controlling fluid operated means to again cause the ring rail to lower. Thus, a reciprocating back and forth motion adjacent the bottom of the spindles 12 occurs for building a bunch of yarn at the bottom of the spindles during start-up. In the case of the building of a tie down wrap of yarn, this reciprocating back and forth motion would be very slight. The amount of yarn wrapped around the bottom of the spindles during this bunch or tie down wrap building operation is controlled by the length of the high lobe on cam C-5 and when the normally open circuit of switch S-5 is again opened by rotation of cam C-5, electricity will be shut off through the switch 80 and thus deactuates the bunch building operation.

After the cams C-5 has timed out, and the timing motor has rotated the remaining cams through their second 180° of rotation, all of the circuits of the cam operated switches have returned to their normal operating positions and the timing motor 73 is shut off. Control and operation of the ring rail is now returned to the builder motion mechanisms which begin another cycle of building of packages of yarn Y on the spindles 12. As may be seen, the normally closed circuit of switch S-1 allows manual actuation of the electrical control by the pushbutton switch 85 and operation of the switches 92, 93 and 94, if it is desired to initiate an operating cycle or a part thereof apart from the above-described manual operation or automatic operation.

If desired, a semi-automatic, timed, sequential operation may be provided by this invention, such as elimination of cams C-1 through C-4 and the associated switches and electrical circuit which would provide only an automatic timed sequential operation for the start-up cycle described above. Or, the cams C-5 through C-8 and the associated switches and electrical circuit could be eliminated to provide only an automatic timed sequential operation of the doff preparation cycle described above. With either of these described fully automatic or semi-automatic systems, the selectable manual circuit could be utilized for manually sequentially positioning the elements of the machine 10 for either the doff portion or the start-up portion or both of the above-described cycles.

Thus, the above-described apparatus of this invention has provided suitable control apparatus for either (1) manually operating the control apparatus for positioning the ring rail during the doff and start-up operating sequences, (2) automatically operating the control apparatus for sequentially positioning the ring rail for both doff and start-up, or (3) semi-automatically and manually operating the control apparatus for performing desired portions of the sequential positioning of the ring rail. Also, the apparatus of this invention has provided optional control mechanisms for yarn guide devices and an optional automatically operated latch mechanism for latching the ring rail in the doff position. Further, this invention provides an automatic rewind mechanism associated with the builder motion mechanisms for automatically rewinding of the builder motion mechanisms when the ring rail 14 is in the doff position only, as will now be described below.

The doff preparation and control apparatus of this invention further preferably includes improved builder motion mechanisms including an automatic rewind means associated therewith for automatically rewinding the builder motion mechanisms in conjunction with the positioning of the ring rail 14 in the doff position only and avoids the necessity of any clutch or other electrical or mechanical postive actuation thereof. Heretofore, as pointed out above, conventional builder motion mechanisms required manual rewinding by an operator or mechanical or electrical actuation of an automatic rewinding mechanism following or during doffing of the spindles 12 of a yarn processing machine 10 and this invention has automated such operation to eliminate not only manual lowering of the ring rail 14 during doff and start-up operations of the machine 10, but also manual rewinding of the builder motion mechanims, so that the improved apparatus of this invention may provide completely automated doff preparation and start-up mechanisms.

In accordance with this invention, the builder motion mechanisms include a driven rotating builder cam 100 suitably rotatably mounted on a portion of the stationary machine frame 11 and having a predetermined profile thereon for the desired sequential building of packages of processed yarn. This builder cam 100 is rotated by the main machine motor 88 and is thereby controlled by the above described electrical circuit control means to stop rotation when the main machine motor 88 is stopped and the ring rail 14 has been latched in its doff position.

A builder arm 102 is pivotally mounted at one end thereof on the stationary machine frame 11 and includes a follower 103 carried thereby and positioned to engage the builder cam 100 for pivotal reciprocating back and forth movement of the builder arm 102 under the influence of the builder cam rotation.

Figure 20:
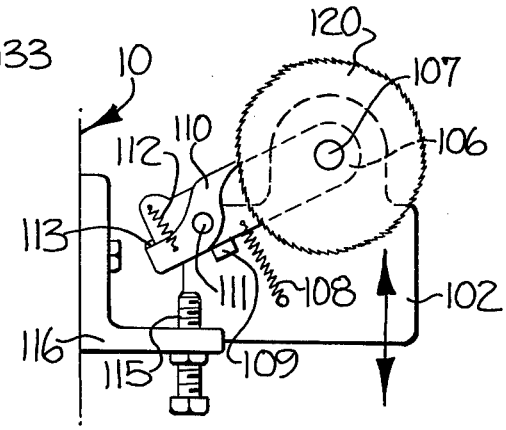
FIG. 20 is a sectional view, taken generally along the line 20—20 of FIG. 12.

Mounted on the builder arm 102 is a pawl device 105 (see FIG. 20) which comprises a lever arm 106 pivotally mounted on stub shaft 107 carried by the builder arm 102. A spring 108 biases lever 106 into engagement with a stop 109 on the builder arm 102. A pawl element 110 is pivotally mounted at 111 on the lever 106 and is biased by a spring 112 into engagement with a stop 113 on the lever arm 106. An adjustable stop 115 is stationarily mounted in a bracket 116 secured to a portion of the stationary machine frame 11. The pawl mechanism 105 is positioned for engaging the stop 115 during each back and forth reciprocating movement of the builder arm 102.

A one-way pick gear 120 is rotatably mounted on stub shaft 107 for engagement by the pawl element 110 of the pawl device 105 such that, during each reciprocating movement of the builder arm 102, the pawl device 105 contacts the stop 115 which moves the pawl device 105 relative to the builder arm 102 for incrementally advancing the pick gear 120 by sliding over a tooth thereon and engaging the next tooth due to the pivoting action of the pawl element 110 against the bias of spring 112. This movement of the pawl device 105 is in the direction opposite to the stop 109 and against the bias of the spring 108.

A first worm gear 125 is also mounted on stub shaft 107 to be carried by the builder arm 102 and is rotated by the pick gear 120 an incremental amount during each incremental advancement of the pick gear 120.

A second worm gear 126 is rotatably mounted about a stationary stub shaft 127 carried by the builder arm 102 and is meshed in engagement with the first worm gear 125 for incremental rotation thereby during each incremental rotation of the first worm gear 125. The second worm gear 126 has projecting one-way ratchet teeth 128 on one face thereof.

Figure 18:
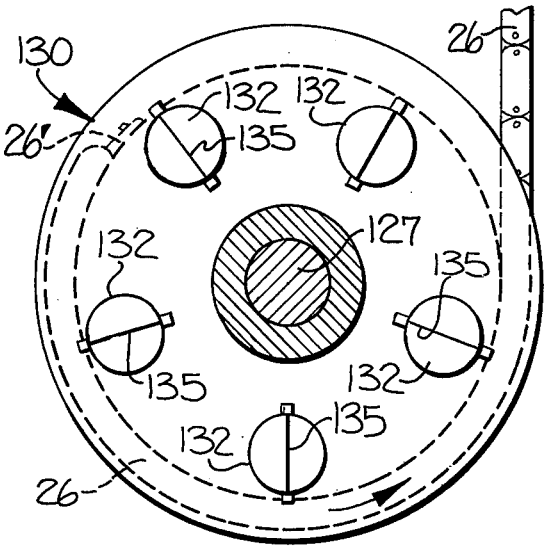
FIG. 18 is a sectional view, taken generally along the line 18—18 of FIG. 14.
Figure 19:
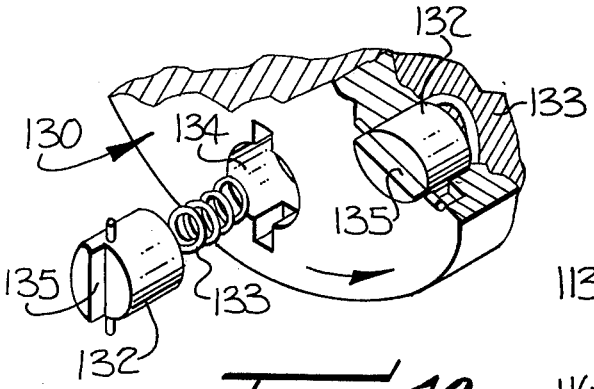
FIG. 19 is an exploded perspective detail of a portion of the devices shown in FIG. 18.

The builder motion mechanism further include a drum device 130 rotatably mounted on stub shaft 127 and positioned for facing the second worm gear 126. On the face of the drum device 130 facing the second worm gear 126, there is provided one-way ratchet pawl devices 132. These one-way ratchet pawl devices 132, as shown particularly in FIGS. 18 and 19, are spring biased by springs 133 in suitable cavities 134 in the face of drum device 130 and have outwardly extending teeth 135 for engagement with the teeth 128 on the second worm gear 126 so that, as the worm gear 126 is rotated incremental amounts, the drum 130 will also be rotated incremental amounts. However, the drum 130 may also rotate in the opposite direction by depression of the pawls 132 against the bias of springs 133 and the teeth 135 sliding over the teeth 128, for purposes to be described below.

Figure 14:
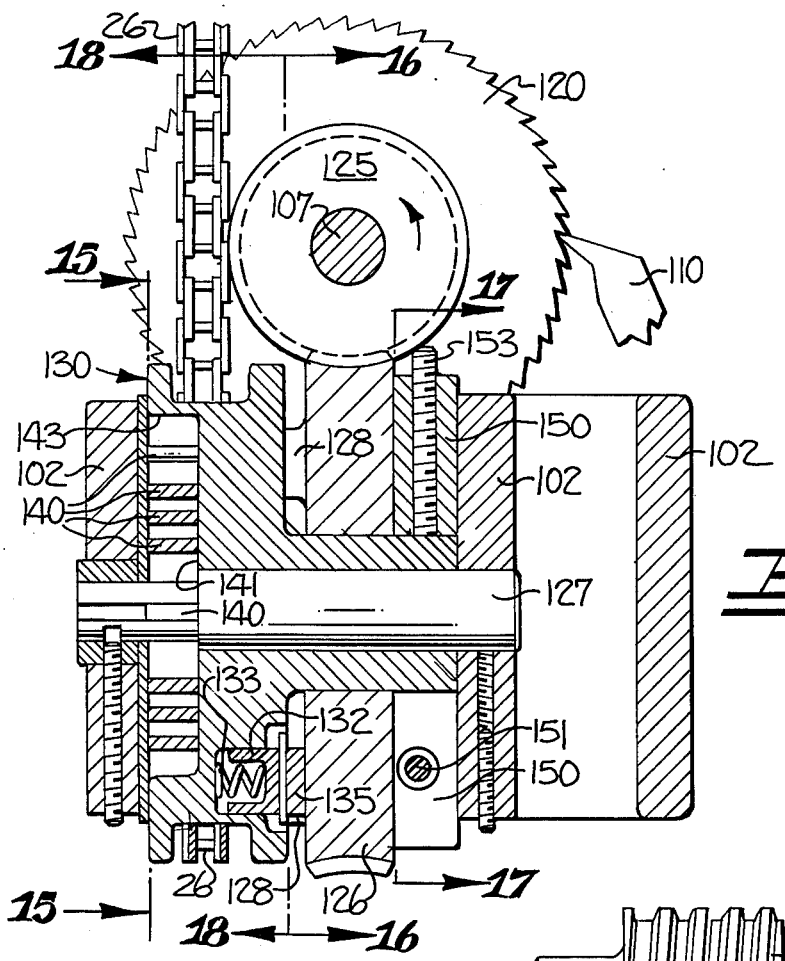
FIG. 14 is a sectional view, taken generally along the line 14—14 of FIG. 12.
Figure 15:
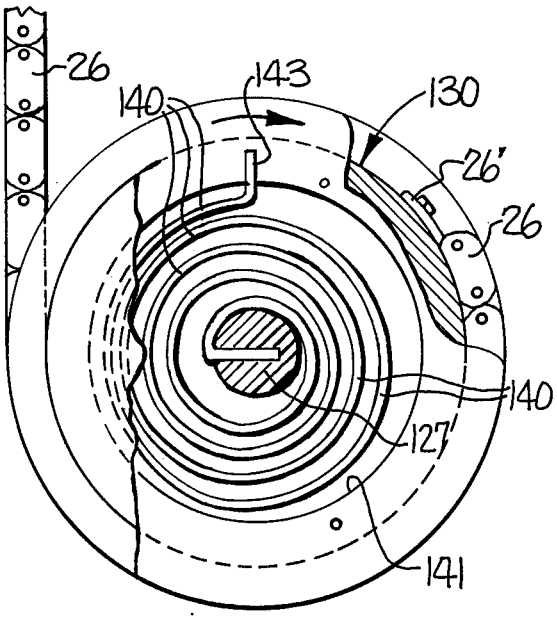
FIG. 15 is a sectional view, taken generally along the line 15—15 of FIG. 14.
Figure 16:
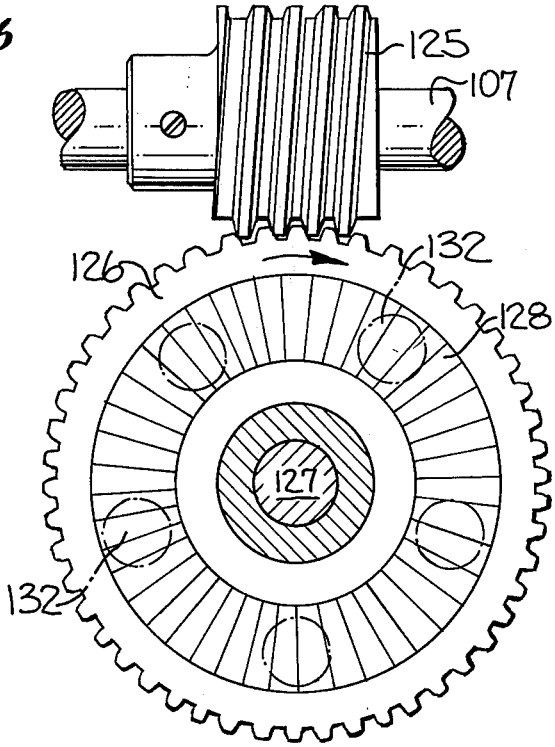
FIG. 16 is a sectional view, taken generally along the line 16—16 of FIG. 14.
Figure 17:
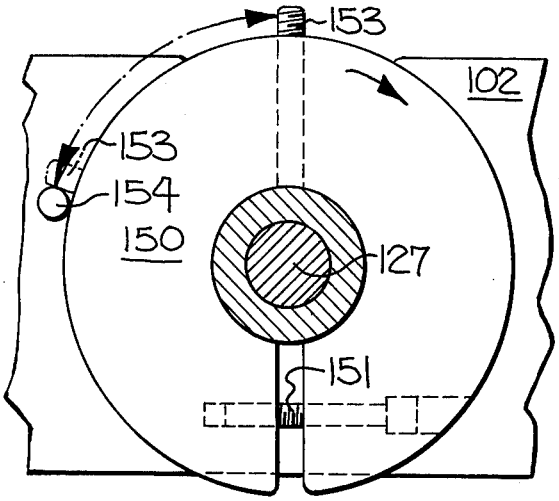
FIG. 17 is a sectional view, taken generally along the line 17—17 of FIG. 14.

The builder chain 26, discussed above, has one end portion 26' secured to the drum 130 and the chain 26 is wrapped around the drum 130, as shown particularly in FIGS. 14 and 17. The builder chain 26 will be let out, unwrapped or extended an incremental amount during each incremental rotation of the drum 130 caused by the up and down reciprocating movement of the builder arm 102 for pivoting the crank arms 16 under the influence of weights 24 slightly downwardly to the left, as viewed in FIG. 1, for moving the ring rail 14 slightly upwardly an incremental amount during each incremental extension of the chain 26. Also, during each back and forth movement of the builder arm 102 under the influence of builder cam 100, the crank arms 16 will be reciprocated back and forth causing up and down movement of the ring rail 14. Accordingly, it may be seen that the ring rail 14 will be reciprocated up and down in short strokes, preferably about 3 inches, about the spindles 12 and will be incrementally advanced up the spindle 12 to the top thereof as the builder chain 26 is let out or unwound from the drum 130.

Figure 6:
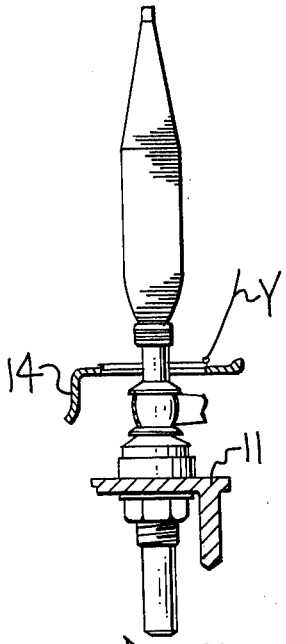

When the ring rail 14 has reached the uppermost or full package position, as illustrated in FIG. 5, and the ring rail 14 is lowered by the above described mechanisms to its doff position, as illustrated in FIG. 6, the chain 26 must be rewound on the drum 130 to again provide the sequential building motion for new packages of processed yarn upon start-up of the yarn processing machine 10.

For purposes of automatically rewinding the chain 26 on the drum 130, the drum 130 is provided with an adjustable strength, torsion spring 140 in a cavity 141 on the other face thereof. One end of the torsion spring 140 is fixed in a slot 143 in the wall 141 of drum 130 with the other end of spring 140 fixed in a slot in the stub shaft 127 so that the torsion spring will stretch against its bias during unwinding of the builder chain 26.

When the ring rail 14 has been lowered below the bobbins on the spindles 12 to its doff position, as shown in FIG. 6, the builder arm 102 will be lowered by the chain 26 to a position in which the builder arm follower 103 is out of engagement with the cam 100. Due to the action of a stop 148 acting on the building arm 102, a slack will be presented in the chain 26 which has been substantially unwound from the drum 130. Since the torsion spring 140 has stretched, this slack in the chain 26 will allow the torsion spring 140 to rewind and rotate the drum 130 in the opposite direction than its normal reciprocating advancement by the pawls 132 sliding over the teeth 128 and thus rewind the chain 26 on the drum 130.

Accordingly, the chain 26 is automatically rewound on the drum 130 and the builder motion mechanisms are now ready for start-up and the beginning of an incremental building of a new package of yarn on the spindles 12. Because of the main machine motor 88 is controlled by the above described electrical circuit control means, the cam 100 is stopped in a predetermined position so that as the ring rail rises during the above described start-up operation, the follower 103 of the builder arm 102 will come back into engagement with the builder cam 100 when the ring rail has reached the dotted line position of FIG. 7 and the cam 100 will again begin to rotate when the main motor 88 is started-up by the electrical circuit control means.

The improved builder motion mechanism may further include a rewind limiting and torsion spring strength adjusting means in the form of a split collar 150 (see FIGS. 14 and 17) which is held together around the stub shaft 127 by a threaded member 151 and includes a threaded adjustable stop element 153 extending outwardly therefrom for engagement with a stop element 154 carried on the builder arm 102 during rewinding of the chain 26 on the drum 130 under the influence of the torsion spring 140. Thus, these cooperating stop devices 153, 154 will limit and stop rotation of the drum 130 under the influence of the torsion spring 140 so that the builder motion rewind means will rewind the builder chain only a predetermined amount. Adjustment of the split collar 150 on the stub shaft 127 and stop devices 153, 154 will wind the torsion spring 140 the desired amount for adjustment of the strength thereof to ensure that the torsion spring will only rewind the builder motion mechanism when the ring rail is in its doff position and has presented sufficient slack in the chain 26. Accordingly, problems of rewinding are avoided when the machine 10 is stopped in the middle of the yarn processing operation for repair and the need for a clutch or other positive electrical or mechanical signal or actuation of the rewind mechanism, as was necessary in prior automatic rewind mechanisms, is avoided.

In the drawings and specfication there have been set forth preferred embodiments of this invention, and although specific terms are employed, they are used in a generic and descriptive sense only and not for purposes of limitation.

What is claimed is:

1. In a textile yarn processing machine, such as spinning and twisting machines, having a stationary frame, rotating yarn receiving spindles carried by said frame, a ring rail vertically reciprocated up and down about said spindles for guiding yarn being processed onto bobbins carried by said spindles in predetermined patterns for building packages of processed yarn, and builder motion mechanisms including a driven crank arm pivotally mounted on said machine frame and operatively connected with said ring rail for reciprocating pivotal movement therewith for reciprocating said ring rail in the predetermined patterns; the combination therewith of doff and start-up ring rail control apparatus for automating ring rail movements for doffing of full packages of processed yarn and start-up of new packages of processed yarn, said apparatus comprising:

independent hydraulic fluid operated means connected to said builder motion mechanisms of said machine and including a hydraulically operated piston and cylinder positively connected between said crank arm and said frame for relative reciprocating movement with respect to each other during reciprocating movements of said crank arm and said ring rail and for cooperating with said builder motion mechanisms for sequentially (1) lowering said ring rail to a doffing position below the bobbins on said spindles, (2) assisting said ring rail to raise under the influence of said builder motion mechanisms to a yarn processing position near the bottom of the bobbins on said spindles by at least controlling the speed of the raising of said ring rail, and (3) lowering and jogging said ring rail up and down adjacent the bottom of the bobbins on said spindles for removing slack and for bunch or wrap building of the yarn during start-up; and electrical circuit control means connected with said fluid operated mens for being actuated to control said fluid operated mass through the operating sequences thereof.

2. In a textile yarn processing machine, as set forth in claim 1, in which said ring rail controlling fluid operated means further includes a source of hydraulic fluid, conduit means connected from said fluid source to said piston and cylinder for allowing the flow of fluid therethrough to and from said piston and cylinder during the relative reciprocating movements of said piston and cylinder, a electrically driven pump means controlled and actuated by said electrical circuit control means for selectively pumping fluid under pressure from said source to said piston and cylinder for positively moving said crank arm and thus said ring rail for at least lowering said ring rail during the doff and start-up operating sequences, and flow restricting means connected in said conduit means for at least restricting the flow of fluid from said piston and cylinder during raising of said ring rail for controlling the speed of the raising of said ring rail.

3. In a textile yarn processing machine, as set forth in claim 1, in which said electrical circuit control means includes a source of electrical energy, an electrical circuit connected between said source of electrical energy and said ring rail controlling fluid operated means for operating same, and a manually actuated switch means connected in said electrical circuit means for being closed and opened for controlling said fluid operating means through the operating sequences thereof.

4. In a textile yarn processing machine, as set forth in claim 1, in which said electrical circuit control means includes first switch means for being actuated upon the positioning of said ring rail in a desired position, timing means electrically connected with said first switch means for being initially actuated thereby upon actuation thereof and including a timing motor and a plurality of cams connected with and driven by said timing motor and cam switch means associated with each of said cams for actuation thereby and being electrically connected with said fluid operated means for timed actuation and deactuation thereof and with said timing motor for maintaining actuation thereof for a predetermined time period after initial actuation of said timing means by said first switch means for automatically controlling a desired portion or all of the sequential operations of said ring rail controlling fluid operated means, and second switch means for being actuated upon the positioning of said ring rail in the bunch or wrap building position during start-up and being electrically connected with said ring rail controlling fluid operated means for predetermined sequential actuation and deactuation thereof for jogging said ring rail and being electrically connected with said timing means for deactuation thereof after a predetermined time period to end the bunch or wrap building.

5. In a textile yarn processing machine, as set forth in claim 4, in which said electrical circuit means further includes a manually actuated switch means connected with said ring rail controlling fluid operated means for manually controlling the portion of the sequential operation thereof which is not automatically controlled by said timing means.

6. In a textile yarn processing machine, as set forth in claim 1, in which said electrical circuit control means includes first switch means automatically actuated by said ring rail upon the positioning of said ring rail in its uppermost position at the completion of the building of a package of processed yarn on each of said spindles, timing means electrically connected with said first switch means for being initially actuated thereby upon actuation thereof and including a timing motor and a plurality of cams connected with and driven by said timing motor and cam switch means associated with each of said cams for actuation thereby and being electrically connected with said fluid operated means for timed actuation and deactuation thereof and with said timing motor for maintaining actuation thereof for a predetermined time period after initial actuation of said timing means by said first switch means for automatically controlling all of the sequential operations of said ring rail controlling fluid operated means, and second switch means for being actuated upon the positioning of said ring rail in the bunch or wrap building position during start-up and being electrically connected with said ring rail controlling fluid operated means for predetermined sequential actuation and deactuation thereof for jogging said ring rail and being electrically connected with said timing means for deactuation thereof after a predetermined time period to end the bunch or wrap building.

7. In a textile yarn processing machine, as set forth in claim 6, in which said electrical circuit control means further includes a manually actuated switch means connected with said ring rail controlling fluid operated means for manually controlling the sequential operation thereof, and selector switch means connected with said ring rail actuated first switch means, said timing means and said ring rail actuated second switch means and connected with said manually actuated switch means for being selectively positioned for activating either an automatic sequential operation or a manual sequential operation of said ring rail controlling fluid operated means.

8. In a textile yarn processing machine, as set forth in claim 6, in which said yarn processing machine includes a main motor for driving said spindles and said builder motion mechanisms and being connected with said cam switch means of said timed electrical circuit control means for being stopped thereby when said ring rail has been positioned in the doff position thereof and for being restarted thereby when said ring rail is being raised during start-up.

9. In a textile yarn processing machine, as set forth in claim 6, in which siad builder motion mechanisms further include a driven, rotating builder cam having a predetermined profile for controlling the desired pattern of reciprocating movement of said ring rail during the building of a package of processed yarn, and said electrical circuit control means further includes switch means for being closed upon the positioning of said builder cam in a desired position after actuation of said ring rail actuated first switch means and being connected with said timing means for allowing operation thereof after being closed by said builder cam to ensure that the sequential operation of said ring rail controlling fluid operated means commences with said ring rail in a desired position.

10. In a textile yarn processing machine, as set forth in claim 1, in which said ring rail controlling fluid operated means further includes a source of hydraulic fluid, first and second conduit means respectively connected from said fluid source to each side of said piston and cylinder for allowing the flow of fluid therethrough to and from said piston and cylinder during the relative reciprocating movements of said piston and cylinder, an electrical pump means controlled and actuated by said electrical circuit control means for selectively pumping fluid under pressure from said source to said piston and cylinder for positively moving said crank arm and thus said ring rail for raising and lowering said ring rail during the doff and start-up operating sequence, a solenoid operated valve positioned in said first and second fluid conduit means for selectively allowing the flow of pumped hydraulic fluid through said first and second conduit means and being connected with said electrical circuit control means for being controlled and actuated thereby, and flow restricting means connected in said conduit means for regulating the flow of fluid therethrough and thus the speed of reciprocating movement of said ring rail during raising and lowering thereof.

11. In a textile yarn processing machine, as set forth in claim 1, in which said apparatus further includes latch means for automatically latching and holding said ring rail in the doff position thereof when said ring rail reaches such position and for automatically releasing said ring rail upon start-up, said latching means comprising a latch member pivotally mounted on said machine frame for movement to and from a latching position in engagement with said ring rail when in its doffing position, and solenoid means connected with said latch member and with said electrical circuit control means for being actuated and deactuated thereby for moving said latch member.

12. In a textile yarn processing machine, as set forth in claim 1, in which said apparatus further includes yarn guide means associated with each of said spindles for guiding yarn to said ring rail and to said spindles during yarn processing, said yarn guide means comprising a yarn guide positioned generally above each of said spindles, means commonly pivotally mounting each of said yarn guides on said machine frame for pivotal movement to and from a yarn processing position generally axially above said spindles to and from a doffing position generally away from the axes of said spindles for doffing of said spindles, and hydraulic fluid operated means connected to said mounting means of said yarn guides and with said ring rail controlling fluid operated means for being operated thereby for moving said yarn guides to and from the processing and doffing positions thereof.

13. In a textile yarn processing machine, as set forth in claim 12, in which said yarn guides include means for vertical reciprocation thereof up and down with said ring rail, and said yarn guide controlling fluid operated means comprises a hydraulic fluid operated piston and cylinder mounted for vertical reciprocating movement up and down with said yarn guides and being operatively connected to said yarn guide mounting means, and flexible conduit means respectively connected from said ring rail controlling fluid operated means to said yarn guide controlling piston and cylinder for moving said yarn guides between the positions thereof.

14. In a textile yarn processing machine, as set forth in claim 1, in which said builder motion mechanisms further include a driven rotating builder cam having a predetermined profile and mounted on said machine frame, a builder arm pivotally mounted on said machine frame and having a follower thereon positioned to engage said building cam for pivotal reciprocating movement back and forth of said arm under the influence of said cam, said arm carrying a biased pawl pivotally mounted thereon, stop means mounted on said machine frame and positioned for engaging and moving said pawl against the bias thereof, during each reciprocating movement of said builder arm, a drum means rotatably mounted on said builder arm and having a one-way pick gear mechanically connected therewith and positioned for engagement by said pawl for incremental advancement of said gear and said drum means in one direction during each back and forth reciprocating movement of said builder arm, a builder chain having one end portion thereof connected around said drum means for back and forth linear movement during the back and forth reciprocation of said builder arm and for being unwound a predetermined amount during each incremental advancement of said drum means, said crank arm being weighted for biasing said ring rail upwardly under the weight of said crank arm and being connected to the other end of said builder chain for being reciprocated thereby against its weight for reciprocating said ring rail in the predetermined patterns, said weighted crank arm acting to bias said builder arm and follower into engagement with said builder cam when said ring rail is in its yarn processing positions and allowing said builder arm to drop out of engagement with said builder cam and provide a slack in said builder chain when said ring rail is lowered to its doff position, and adjustable strength, torsion spring, builder motion rewind means mounted on said drum means for biasing said drum means a predetermined amount in the opposite direction to the incremental advancement thereof to cause said drum means to rotate in the opposite direction and automatically rewind said builder chain thereon only when said ring rail is positioned in the doff position to avoid mechanical rewinding and the necessity for positive actuation of said rewind means and completely automate the builder motion mechanisms of said machine.

15. In a textile yarn processing machine, as set forth in claim 14, in which said builder motion mechanisms further include a first worm gear connected with said pick gear for being rotated thereby an incremental amount during each incremental advancement of said pick gear, a second worm gear meshed with said first worm gear for incremental rotation thereby during each incremental rotation of said first worm gear, said second worm gear having projecting one-way ratchet teeth on one face thereof which is positioned adjacent a face of said drum means, and said drum means having on the adjacent face thereof spring-biased one-way ratchet pawls for engagement with said ratchet teeth on said second worm gear during the incremental rotation of said second worm gear for incremental advancement of said drum means to allow said builder chain to be unwound a predetermined amount during each incremental advancement of said drum means and for being depressed against the bias thereof to allow said drum means to rotate in the opposite direction relative to said second worm gear under the influence of said torsion spring, builder motion rewind means during automatic rewinding of said builder chain.

16. In a textile yarn processing machine, as set forth in claim 15, in which said builder motion mechanisms further include adjustable stop means operatively connected with said drum means for adjusting the strength of said torsion spring and for limiting and stopping rotation of said drum means under the influence of said torsion spring builder motion rewind means for allowing rewinding of said builder chain only a predetermined desired amount and only when a predetermined slack is present in said builder chain when said ring rail is in the doff position.

17. In a textile yarn processing machine, such as spinning and twisting machines, having a stationary frame, rotating yarn receiving spindles carried by said frame, a ring rail vertically reciprocated up and down about said spindles for guiding yarn being processed onto bobbins carried by said spindles in predetermined patterns for building packages of processed yarn, and builder motion mechanisms including a driven crank arm pivotally mounted on said machine frame and operatively connected with said ring rail for reciprocating pivotal movement therewith for reciprocating said ring rail in the predetermined patterns; the combination therewith of doff and start-up ring rail control apparatus for automating ring rail movements for doffing of full packages of processed yarn and start-up of new packages of processed yarn, said apparatus comprising:

independent hydraulic fluid operated means connected to said builder motion mechanisms of said machine and cooperating therewith for sequentially (1) lowering said ring rail to a doffing position below the bobbins on said spindles, (2) assisting said ring rail to raise under the influence of said builder motion mechanisms to a yarn processing positions near the bottom of the bobbins on said spindles by at least controlling the speed of raising of said ring rail, and (3) lowering and jogging said ring rail up and down adjacent the bottom of the bobbins on said spindles for removing slack and for bunch or wrap building of the yarn during start-up, said fluid operated means including a hydraulically operated piston and cylinder positively connected between said crank arm and said frame for relative reciprocating movement with respect to each other during reciprocating movements of said crank arm and said ring rail, a source of hydraulic fluid, conduit means connected from said fluid source to said piston and cylinder for allowing the flow of fluid therethrough to and from said piston and cylinder during the relative reciprocating movements of said piston and cylinder, an electrically driven pump means for selectively pumping fluid under pressure from said source to said piston and cylinder for positively moving said crank arm and thus said ring rail for at least lowering said ring rail during the doff and start-up operating sequences, and flow restricting means connected in said conduit means for at least restricting the flow of fluid from said piston and cylinder during raising of said ring rail for controlling the speed of the raising of said ring rail; and electrical circuit control means connected with said fluid operated means for being actuated to control said fluid operated means through the operating sequences thereof, said electrical circuit control means including a source of electrical energy, an electrical circuit connected between said source of electrical energy and said ring rail controlling fluid operated means for operating same, a manually actuated switch means connected in said electrical circuit for being closed and opened for controlling said fluid operating means through the operating sequences thereof.

18. In a textile yarn processing machine, as set forth in claim 17, in which said electrical circuit control means further includes first switch means connected in said circuit for being actuated upon the positioning of said ring rail in a desired position, timing means electrically connected in said circuit with said first switch means for being initially actuated thereby upon actuation thereof and including a timing motor and a plurality of cams connected with and driven by said timing motor and cam switch means associated with each of said cams for actuation thereby and being electrically connected in said circuit with said fluid operated means for timed actuation and deactuation thereof and with said timing motor for maintaining actuation thereof for a predetermined timed period after initial actuation of said timing means by said first switch means for automatically controlling a desired portion or all of the sequential operations of said ring rail controlling fluid operated means, and second switch means for being actuated upon the positioning of said ring rail in the bunch or wrap building position during start-up and being electrically connected with said ring rail controlling fluid operated means for predetermined sequential actuation and deactuation thereof for jogging said ring rail and being electrically connected in said circuit with said timing means for deactuation thereof at a predetermined time period to end the bunch or wrap building.

19. In a textile yarn processing machine, as set forth in claim 18, in which said first switch means comprises switch means automatically actuated by said ring rail upon the positioning of said ring rail in its uppermost position at the completion of the building of a package of processed yarn on each of said spindles, said timing means comprising timing means for automatically controlling all of the sequential operations of said ring rail controlling fluid operated means, and said electrical circuit control means further including selector switch means connected in said circuit with said ring rail actuated first switch means, said timing means and said ring rail actuated second switch means and connected with said manually actuated switch means for being selectively positioned for actuating either an automatic sequential operation or a manual sequential operation of said ring rail controlling fluid operated means.

20. In a textile yarn processing machine, as set forth in claim 19, in which said builder motion mechanism further includes a driven, rotating builder cam having a predetermined profile for controlling the desired pattern of reciprocating movement of said ring rail during the building of a package of processed yarn, and said electrical circuit control means further includes switch means for being closed upon the positioning of said builder cam in a desired position after actuation of said ring rail actuated first switch means and being connected in said circuit with said timing means for allowing operation thereof after being closed by said builder cam to insure that the sequential operation of said ring rail controlling fluid operated means commences with said ring rail in a desired position.

21. In a textile yarn processing machine, as set forth in claim 17, in which said apparatus further includes latch means for automatically latching and holding said ring rail in the doff position thereof when said ring rail reaches such position and for automatically releasing said ring rail upon start-up, said latching means comprising a latch member pivotally mounted on said machine frame for movement to and from a latching position in engagement with said ring rail when in its doffing position, and solenoid means connected with said latch member and with said electrical circuit control means for being actuated and deactuated thereby for moving said latch member.

22. In a textile yarn processing machine, as set forth in claim 17, in which said circuit means of said fluid operated means comprises first and second conduit means respectively connected from said fluid source to each side of said piston and cylinder for allowing the flow of fluid therethrough to and from said piston and cylinder during the relative reciprocating movements of said piston and cylinder, said flow restricting means comprises flow restricting means connected in each of said conduit means for regulating the flow of fluid therethrough and thus the speed of reciprocating movement of said ring rail during raising and lowering thereof, and said ring rail controlling fluid operated means further includes a solenoid operated valve positioned in said first and second fluid conduit means for selectively allowing the flow of pumped hydraulic fluid through said first and second conduit means for positively raising and lowering of said ring rail upon selected positioning of said valve and being connected with said electrical circuit control means for being controlled and actuated thereby.

23. In a textile yarn processing machine, as set forth in claim 22, in which said apparatus further includes yarn guide means associated with each of said spindles for guiding yarn to said ring rail and to said spindles during yarn processing, said yarn guide means comprising a yarn guide positioned generally above each of said spindles and including means for vertical reciprocation thereof up and down with said ring rail, means commonly pivotally mounting each of said yarn guides on said machine frame for pivotal movement to and from a yarn processing position generally axially above spindles to and from a doffing position generally away from the axes of said spindles for doffing of said spindles, and hydraulic fluid operated means connected to said mounting means of said yarn guides and with said ring rail controlling fluid operated means for being operated thereby for moving said yarn guides to and from the processing and doffing positions thereof, said yarn guide controlling fluid operated means comprising a hydraulic fluid operated piston and cylinder mounted for vertical reciprocating movement up and down with said yarn guides and being operatively connected to said yarn guide mounting means, and flexible conduit means respectively connected from said first and second fluid conduit means to said yarn guide controlling piston and cylinder for allowing hydraulic fluid under pressure to flow from said source to said yarn guide controlling piston and cylinder for moving said yarn guides between the positions thereof.

24. In a textile yarn processing machine, such as spinning and twisting machines, having a stationary frame, rotating yarn receiving spindles carried by said frame, a ring rail vertically reciprocated up and down about said spindles for guiding yarn being processed onto bobbins carried by said spindles in predetermined patterns for building packages of processed yarn, and builder motion mechanisms including a driven crank arm pivotally mounted on said machine frame and operatively connected with said ring rail for reciprocating pivotal movement therewith for reciprocating said ring rail in the predetermined pattern; the combination therewith of automatic doff and start-up ring rail control apparatus for automating ring rail movements for doffing of full packages of processed yarn and start-up of new packages of processed yarn, said apparatus comprising:

independent hydraulic fluid operated means connected to said builder motion mechanisms of one of said machines only for sequentially (1) lowering said ring rail to a doffing position below the bobbins on said spindles, (2) assisting said ring rail to raise under the influence of said builder motion mechanisms to a yarn processing position near the bottom of the bobbins on said spindles, and (3) lowering and jogging said ring rail up and down adjacent the bottom of the bobbins on said spindles for removing slack and for bunch building of the yarn during start-up, said hydraulic fluid operated means including a hydraulically operated piston and cylinder positively connected between said crank arm and said frame for relative reciprocating movement with respect to each other during said reciprocating movements of said crank arm and said ring rail; and timed electrical circuit control means connected with said fluid operated means and said ring rail for being actuated by predetermined positions of said ring rail for actuating and controlling said fluid operated means through the operating sequences thereof.

25. In a textile yarn processing machine, such as spinning and twisting machines, having a stationary frame, rotating yarn receiving spindles carried by said frame, a ring rail vertically reciprocated up and down about said spindles for guiding yarn being processed onto bobbins carried by said spindles in predetermined patterns for building packages of processed yarn, yarn guide means associated with each of said spindles for guiding yarn to said ring rail and to said spindles during yarn processing, and builder motion mechanisms including a driven crank arm pivotally mounted on said machine frame and operatively connected with said ring rail for reciprocating pivotal movement thereof for reciprocating said ring rail in the predetermined patterns; the combination therewith of control apparatus for automating movements of various elements of said yarn processing machine for preparing said yarn processing machine for doffing of full packages of processed yarn and for start-up of new packages of processed yarn, said apparatus comprising:

independent hydraulic fluid operated means connected to said builder motion mechanisms of one of said machines only for sequentially (1) lowering said ring rail to a doffing position below the bobbins on said spindles, (2) assisting said ring rail to raise under the influence of said builder motion mechanisms to a yarn processing position near the bottom of the bobbins on said spindles, and (3) lowering and jogging said ring rail up and down adjacent the bottom of the bobbins on said spindles for removing slack and for bunch building of the yarn during start-up, said hydraulic fluid operated means including a hydraulically operated piston and cylinder positively connected between said crank arm and said frame for relative reciprocating movements with respect to each other during each reciprocating movement of said crank arm and said ring rail;

a latch member pivotally mounted on said machine frame for movement to and from a latching position in engagement with said ring rail when in its doffing position and including solenoid means connected therewith for moving said latch member;

means commonly pivotally mounting each of said yarn guides on said machine frame for pivotal movement to and from a yarn processing position generally axially above said spindles to and from a doffing position generally away from the axes of said spindles for doffing of said spindles and having hydraulic fluid operated means connected therewith and with said ring rail controlling fluid operated means for being operated thereby for moving said yarn guides to and from the processing and doffing positions thereof in relation to the position of said ring rail;

timed electrical circuit control means operatively connected with said ring rail controlling fluid operated means and said latch member solenoid means for being actuated by predetermined positions of said ring rail for actuating and controlling the sequential positioning of said ring rail, said latch member and said yarn guides for doffing and start-up of said yarn processing machine; and builder motion rewind means connected with said builder motion mechanisms and controlled by the positioning of said ring rail in the doff position for automatically rewinding said builder motion mechanisms.

26. In a textile yarn processing machine such as spinning and twisting machines, having a stationary frame, rotating yarn receiving spindles carried by said frame, a ring rail vertically reciprocated up and down about said spindles for guiding yarn being processed onto bobbins carried by said spindles in predetermined patterns for building packages of processed yarn, and builder motion mechanisms including a driven crank arm pivotally mounted on said machine frame and operatively connected with said ring rail for reciprocating pivotal movement thereof for reciprocating said ring rail in the predetermined patterns; the combination therewith of automatic doff and start-up ring rail control apparatus for automating ring rail movements for doffing of full packages of processed yarn and start-up of new packages of processed yarn, said apparatus comprising:

independent hydraulic fluid operated means connected to said builder motion mechanisms of one of said machines only for sequentially (1) lowering said ring rail to a doffing position below the bobbins on said spindles, (2) assisting said ring rail to raise under the influence of said builder motion mechanisms to a yarn processing position near the bottom of the bobbins on said spindles, and (3) lowering and jogging said ring rail up and down adjacent the bottom of the bobbins on said spindles for removing slack and for bunch building of the yarn during start-up;

timed electrical circuit control means connected with said fluid operated means and said ring rail for being actuated by predetermined positions of said ring rail for actuating and controlling said fluid operated means through the operating sequences thereof; and timed electrical circuit control means connected with said fluid operated means and said ring rail for being actuated by predetermined positions of said ring rail for actuating and controlling said fluid operated means through the operating sequences thereof; and said hydraulically operated means comprising a piston and cylinder positively connected between said crank arm and said frame for relative reciprocating movements with respect to each other during each reciprocating movement of said crank arm and said ring rail, a source of hydraulic fluid, first and second conduit means connected from said fluid source to each side of said piston and cylinder for allowing the flow of fluid therethrough to and from said piston and cylinder during the relative reciprocating movements of said piston and cylinder, and an electrically driven pump means controlled and actuated by said electrical circuit control means for selectively pumping fluid under pressure from said source to said piston and cylinder for positively moving said crank arm and thus said ring rail during the doff and start-up operating sequences.

* * * * *

UNITED STATES PATENT AND TRADEMARK OFFICE

CERTIFICATE OF CORRECTION

PATENT NO. : 4,026,096

DATED : May 31, 1977

INVENTOR(S) : William Ira Stuart

It is certified that error appears in the above-identified patent and that said Letters Patent are hereby corrected as shown below:

Column 1, line 58 - "nism" should be --nisms--.
Column 2, line 24, "be" should be --by--.
Column 3, line 47, "mechanism" should be --mechanisms--.
Column 10, line 32, after "packages" insert --of processed--.
Column 11, line 38, after "rail" insert --14--.
Column 12, line 20, "off" should be --doff--.
Column 13, line 39, "manual" should be --"Manual"--.
Column 13, line 50, "Automatic" should be --"Automatic"-- (with quotation marks).
Column 19, line 56, "postive" should be --positive--.
Column 21, line 59, after "Because" delete --of--.
Column 23, line 2, "mens" should be --means--.
Column 23, line 3, "mass" should be --means--.
Column 23, line 14, "a" should be --an--.
Column 24, line 66, "siad" should be --said--.
Column 27, line 68, "positions" should be --position--.
Column 29, line 57, "circuit" should be --conduit--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademark*